US012768267B2

(12) United States Patent
Lowdon et al.

(10) Patent No.: US 12,768,267 B2
(45) Date of Patent: Oct. 20, 2026

(54) SYSTEMS AND METHODS FOR DOWNHOLE COMMUNICATION

(71) Applicant: Schlumberger Technology Corporation, Sugar Land, TX (US)

(72) Inventors: Ross Lowdon, Aberdeen (GB); Edward Richards, Cheltenham (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 19/214,070

(22) Filed: May 21, 2025

(65) Prior Publication Data

US 2025/0369349 A1 Dec. 4, 2025

Related U.S. Application Data

(60) Provisional application No. 63/653,495, filed on May 30, 2024.

(51) Int. Cl.
*E21B 47/12* (2012.01)
*E21B 4/20* (2006.01)

(52) U.S. Cl.
CPC ..... *E21B 47/12* (2013.01); *E21B 4/20* (2013.01)

(58) Field of Classification Search
None
See application file for complete search history.

(56) References Cited

U.S. PATENT DOCUMENTS

| | | | | |
|---|---|---|---|---|
| 11,913,326 | B2 * | 2/2024 | Hough | E21B 47/18 |
| 2005/0001737 | A1 * | 1/2005 | Baron | G01V 11/002 340/854.4 |
| 2005/0194183 | A1 * | 9/2005 | Gleitman | E21B 17/07 175/45 |
| 2017/0264220 | A1 * | 9/2017 | Rattan | H02P 27/08 |
| 2020/0157931 | A1 * | 5/2020 | Jones | E21B 44/04 |
| 2025/0215776 | A1 * | 7/2025 | Hinke | E21B 44/00 |

FOREIGN PATENT DOCUMENTS

CA 2901781 C 5/2020

* cited by examiner

*Primary Examiner* — Steven Lim
(74) *Attorney, Agent, or Firm* — Jeffrey D. Frantz

(57) ABSTRACT

A downhole communication device includes a downhole tool implemented in a wellbore. A magnetic component is connected to the downhole tool and configured to generate a polarized magnetic field. The downhole communication device includes a means for modulating the polarized magnetic field of the magnetic component to encode a bit sequence into the polarized magnetic field.

12 Claims, 7 Drawing Sheets

SYSTEMS AND METHODS FOR DOWNHOLE COMMUNICATION

CROSS REFERENCE TO RELATED APPLICATIONS

This application claims priority to and the benefit of U.S. Provisional Patent Application No. 63/653,495, filed on May 30, 2024, which is hereby incorporated by reference in its entirety.

BACKGROUND OF THE DISCLOSURE

Wellbores may be drilled into a surface location or seabed for a variety of exploratory or extraction purposes. For example, a wellbore may be drilled to access fluids, such as liquid and gaseous hydrocarbons, stored in subterranean formations and to extract the fluids from the formations. Wellbores used to produce or extract fluids may be formed in earthen formations using earth-boring tools such as drill bits for drilling wellbores and reamers for enlarging the diameters of wellbores.

Communication with downhole tools implemented within wellbores is typically achieved by communicating to the downhole tool from the surface through techniques such as modulation of drilling parameters (i.e., mud pulses) and other telemetry techniques. In some cases, multiple wellbores may be positioned in an oilfield or borefield with respect to one another. In some circumstances, it may be desirable for downhole tools implemented in different wellbores to communicate directly with each other without having to route communications through surface components, which can be inefficient, unreliable, and disruptive. Thus, improved techniques for communicating between downhole tools may be advantageous.

BRIEF DESCRIPTION OF THE DRAWINGS

In order to describe the manner in which the above-recited and other features of the disclosure can be obtained, a more particular description will be rendered by reference to specific embodiments thereof which are illustrated in the appended drawings. For better understanding, the like elements have been designated by like reference numbers throughout the various accompanying figures. While some of the drawings may be schematic or exaggerated representations of concepts, at least some of the drawings may be drawn to scale. Understanding that the drawings depict some example embodiments, the embodiments will be described and explained with additional specificity and detail through the use of the accompanying drawings in which:

FIGS. 3-1 and 3-2 illustrate an example of a drilling tool assembly including a magnetic component, according to at least one embodiment of the present disclosure;

FIG. 3-3 illustrates an example of bi-directional communication between a first drilling tool assembly and another tool, such as another drilling tool assembly, according to at least one embodiment of the present disclosure;

FIGS. 4-1 and 4-2 illustrate examples of modulating a polarized magnetic field through rotation, according to embodiments of the present disclosure.

DETAILED DESCRIPTION

This disclosure generally relates to systems and methods for downhole communication through magnetic signals. A drilling tool assembly includes a magnetic component for generating a polarized magnetic field. A polarity of the polarized magnetic field is oriented transverse to a longitudinal axis of the drilling tool assembly and may be selectively positionable. The magnetic component includes or is otherwise associated with a means for modulating the polarized magnetic field. For example, the polarized magnetic field may be modulated based on rotating the polarized magnetic field either in connection with a rotation of the magnetic component and/or the drilling tool assembly, or independent of the magnetic component and/or the drilling tool assembly. Rotation of the magnetic field may facilitate modulating the polarized magnetic field, for example, by selectively rotating the polarized magnetic field at one or more specific frequencies, or by selectively orienting a specific magnetic pole of the polarized magnetic field. In another example, the polarized magnetic field may be modulated based on controlling an intensity or strength of the polarized magnetic field.

A magnetic receiver, such as at another drilling tool assembly, at a surface, at another location of the drilling tool assembly, etc., may be configured to detect the polarized magnetic field and the modulations in the polarized magnetic field. In this way, a bit sequence may be encoded into the polarized magnetic field to generate a modulated polarized magnetic field for transmitting information from the drilling tool assembly. For instance, drilling parameters such as steering parameters may be transmitted from one bottom hole assembly ("BHA") in one wellbore to another BHA in another wellbore for facilitating instructing the BHAs to steer in conjunction as part of autonomous drilling operation. Any information accessible to the drilling tool assembly (and the magnetic component) may reasonably be communicated through the modulations of the polarized magnetic field. In this way, communication from a drilling tool assembly, or for example, between parallel drilling tool assemblies, may be substantially improved over conventional techniques which typically involve communications to and from the surface through unreliable, slow, and disruptive means such as downlinks and other forms of downhole telemetry.

Figure 1:
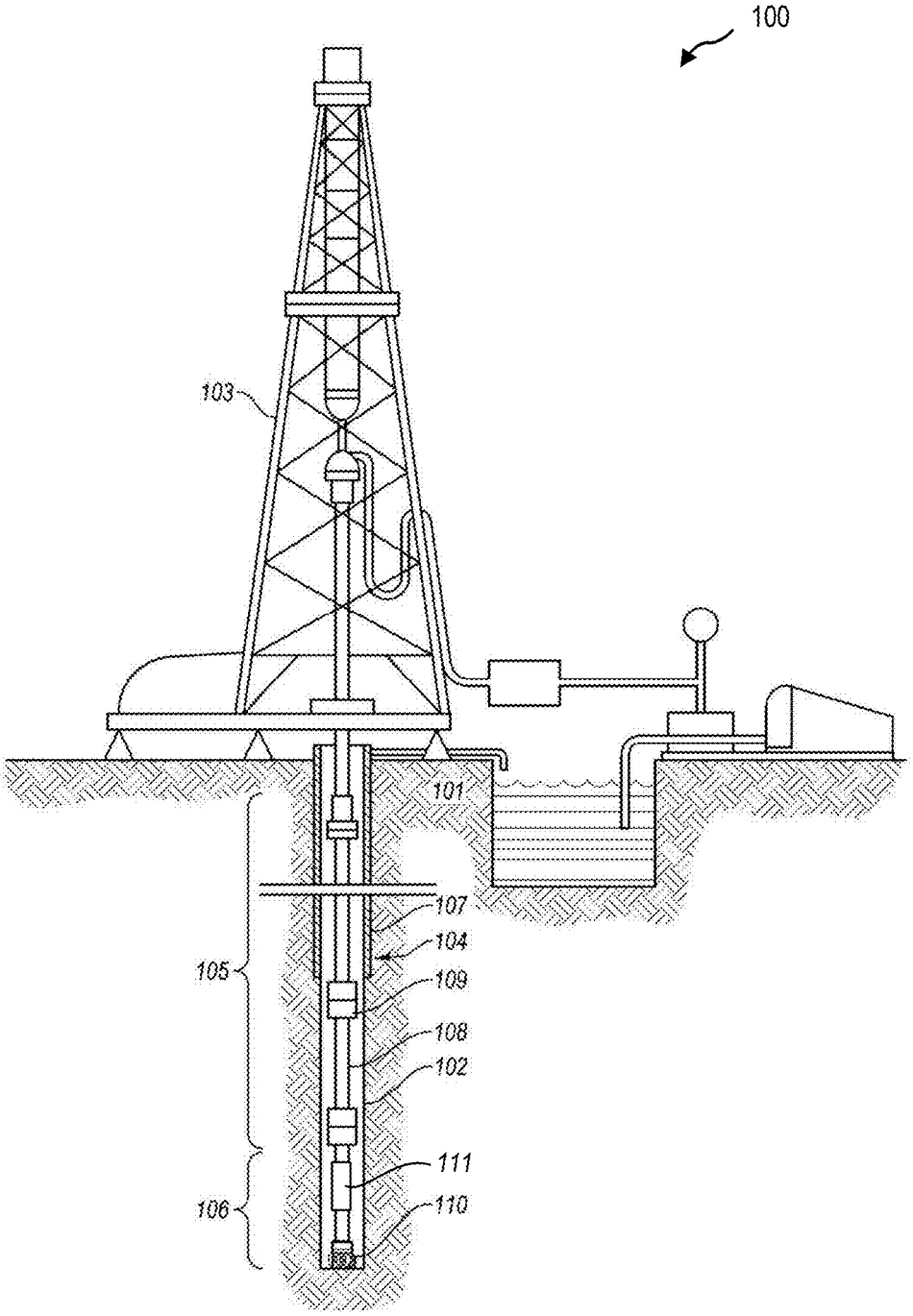
FIG. 1 is an example of a downhole system, according to at least one embodiment of the present disclosure.

Additional details will now be provided regarding systems described herein in relation to illustrative figures portraying example implementations. For example, FIG. 1 shows one example of a downhole system 100 for drilling an earth formation 101 to form a wellbore 102. The downhole system 100 includes a drill rig 103 used to turn a drilling tool assembly 104 which extends downward into the wellbore 102. The drilling tool assembly 104 may include a drill string 105, a BHA 106, and a bit 110, attached to the downhole end of the drill string 105.

The drill string 105 may include several joints of drill pipe 108 connected end-to-end through tool joints 109. The drill string 105 transmits drilling fluid through a central bore and transmits rotational power from the drill rig 103 to the BHA 106. In some embodiments, the drill string 105 further includes additional downhole drilling tools and/or components such as subs, pup joints, etc. The drill pipe 108 provides a hydraulic passage through which drilling fluid is pumped from the surface. The drilling fluid discharges through selected-size nozzles, jets, or other orifices in the bit 110 for the purposes of cooling the bit 110 and cutting structures thereon, and for lifting cuttings out of the wellbore 102 as it is being drilled.

The BHA 106 may include the bit 110, other downhole drilling tools, or other components. An example BHA 106 may include additional or other downhole drilling tools or components (e.g., coupled between the drill string 105 and the bit 110). Examples of additional BHA components include drill collars, stabilizers, measurement-while-drilling ("MWD") tools, logging-while-drilling ("LWD") tools, downhole motors, underreamers, section mills, hydraulic disconnects, jars, vibration or dampening tools, other components, or combinations of the foregoing.

In general, the downhole system 100 may include other downhole drilling tools, components, and accessories such as special valves (e.g., kelly cocks, blowout preventers, and safety valves). Additional components included in the downhole system 100 may be considered a part of the drilling tool assembly 104, the drill string 105, or a part of the BHA 106, depending on their locations in the downhole system 100.

The bit 110 in the BHA 106 may be any type of bit suitable for degrading downhole materials. For instance, the bit 110 may be a drill bit suitable for drilling the earth formation 101. Example types of drill bits used for drilling earth formations are fixed-cutter or drag bits. In other embodiments, the bit 110 may be a mill used for removing metal, composite, elastomer, other materials downhole, or combinations thereof. For instance, the bit 110 may be used with a whipstock to mill into casing 107 lining the wellbore 102. The bit 110 may also be a junk mill used to mill away tools, plugs, cement, other materials within the wellbore 102, or combinations thereof. Swarf or other cuttings formed by use of a mill may be lifted to the surface or may be allowed to fall downhole. The bit 110 may include one or more cutting elements for degrading the earth formation 101.

The BHA 106 may further include steering components such as a rotary steerable system (RSS). The RSS may include directional drilling tools that change a direction of the bit 110, and thereby the trajectory of the wellbore. At least a portion of the RSS may maintain a geostationary position relative to an absolute reference frame, such as one or more of gravity, magnetic north, or true north. Using measurements obtained with the geostationary position, the RSS may locate the bit 110, change the course of the bit 110, and direct the directional drilling tools on a projected trajectory. The RSS may steer the bit 110 in accordance with or based on a trajectory for the bit 110. For example, a trajectory may be determined for directing the bit 110 toward one or more subterranean targets such as an oil or gas reservoir.

In some embodiments, the downhole system 100 includes a magnetic component 111. The magnetic component 111 may be configured to generate and/or modulate a polarized magnetic field such that the downhole system 100 may communicate information via the magnetic component 111 (e.g., via the polarized magnetic field), for example, from the BHA 106 of the downhole system. For example, the magnetic component 111 may include, or may be associated with, a means for modulating the polarized magnetic field in order to encode a bit sequence into the polarized magnetic field as described herein. In some embodiments, the magnetic component 111 may be, or may be part of, a ranging tool or ranging component of the downhole system 100. In some embodiments, a downhole system (e.g., the downhole system 100 or another downhole system, BHA, downhole tool, etc.) may be equipped with a magnetic receiver for receiving information as encoded bit sequences in a polarized magnetic field. For example, the magnetic receiver may be part of an MWD tool, LWD tool, ranging tool, or may be a dedicated tool for receiving communications via a modulated polarized magnetic field. In this way, the downhole system 100 may be configured to communicate (e.g., uni- or bi-directional communication) by transmitting and/or receiving signals through a polarized magnetic field.

Figure 2:
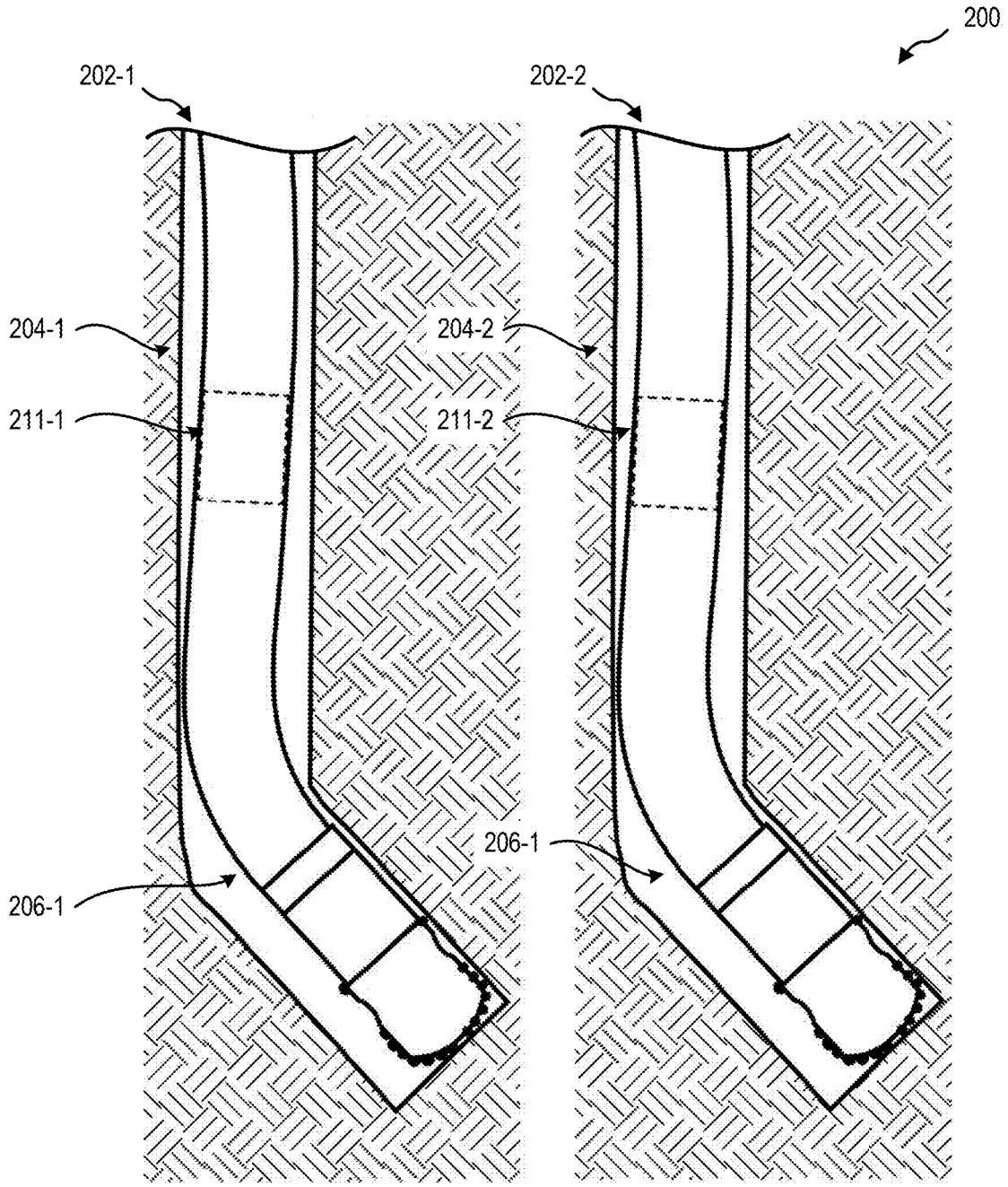
FIG. 2 shows an example of a downhole system in which a first wellbore and a second wellbore are positioned with respect to each other, according to at least one embodiment of the present disclosure.

In some embodiments, a downhole system may be implemented to form a wellbore in an oilfield or borefield with respect to another wellbore. FIG. 2 shows an example of a downhole system 200 in which a first wellbore 202-1 and a second wellbore 202-2 (collectively wellbores 202) are positioned with respect to each other, according to at least one embodiment of the present disclosure. For example, the wellbores 202 may be adjacent or parallel wellbores. The wellbores 202 may be two wellbores of a borefield (e.g., of many wellbores), such as for a geothermal energy application. The wellbores 202 may be wellbores in an oilfield that are positioned close to each other such as to access a similar formation or subterranean target. The wellbores 202 may be wellbores that are otherwise positioned relative to each other for any other purpose.

A first drilling tool assembly 204-1 having a first BHA 206-1 may be implemented to drill, form, and/or modify the first wellbore 202-1 and a second drilling tool assembly 204-2 having a second BHA 206-2 may be implemented to drill, form, and/or modify the second wellbore 202-2. The first wellbore 202-1 and second wellbore 202-2 may be drilled, formed, and/or modified at the same time or at different times. For example, in some cases, such as when forming wellbores for a borefield for accessing geothermal resources, two or more wellbores may be formed at the same (or at least somewhat overlapping) time. In another example, one wellbore may be formed with respect to another (e.g., already formed) wellbore. For the purposes of discussion, the first wellbore 202-1 and second wellbore 202-2 and/or components corresponding to a respective wellbore may be described as "parallel," such as parallel wellbores, parallel BHAs, etc. It should be understood that this description of components being "parallel" is for ease of discussion and should be understood as referring to associated components that are positioned relative to one another without requiring that the components be aligned or oriented in a strictly parallel configuration. For example, the first wellbore 202-1 and the second wellbore 202-2 may be parallel wellbores in that they are positioned and/or oriented with respect to each other, while not necessarily being parallel in a geometric sense.

In some embodiments, while forming a wellbore with respect to another (e.g., parallel) wellbore, it may be advantageous to locate a relative position of one or both wellbores. For instance, it may be desirable to prevent the wellbores from intersecting or to maintain a certain distance between the wellbores. In other cases, it may be desirable to join or intersect a wellbore with another wellbore at one or more locations. Thus, it may be advantageous to locate the relative locations of parallel wellbores. This may be accomplished in many ways. For example, a drill plan may outline a trajectory for a wellbore to follow and/or may outline the actual trajectory of a wellbore. One or more measurements may be collected for measuring and/or mapping the geometry of a wellbore. In some cases, however, tracking or determining the geometry or trajectory of a wellbore in these ways may be unreliable, inaccurate, or otherwise unavailable.

In some embodiments, a downhole system may include tool(s) implemented downhole for detecting and/or measuring the location, position, and/or relative distance of another wellbore. For example, a downhole system may include one or more magnetic components for facilitating determining a location of one or more wellbores. As shown in FIG. 2, one or more of the first drilling tool assembly 204-1 or the second drilling tool assembly 204-2 may include a magnetic component 211-1 or 211-2 (respectively). The magnetic component may be included as part of the BHA, at a location uphole of the BHA, or at any other location of the drilling tool assembly. The magnetic component may be implemented as a ranging tool for (e.g., passively) determining the range between wellbores. The magnetic component may be implemented as a communication component for (e.g., actively) communicating information (e.g., bit sequences) between parallel wellbores, parallel BHAs, etc., (e.g., uni- or bi-directional communication). In some embodiments, the magnetic component may include or may be associated with (e.g., implemented with) a magnetic receiver for detecting magnetic signals from a magnetic component (e.g., implemented in a parallel wellbore).

Figures 1, 3:
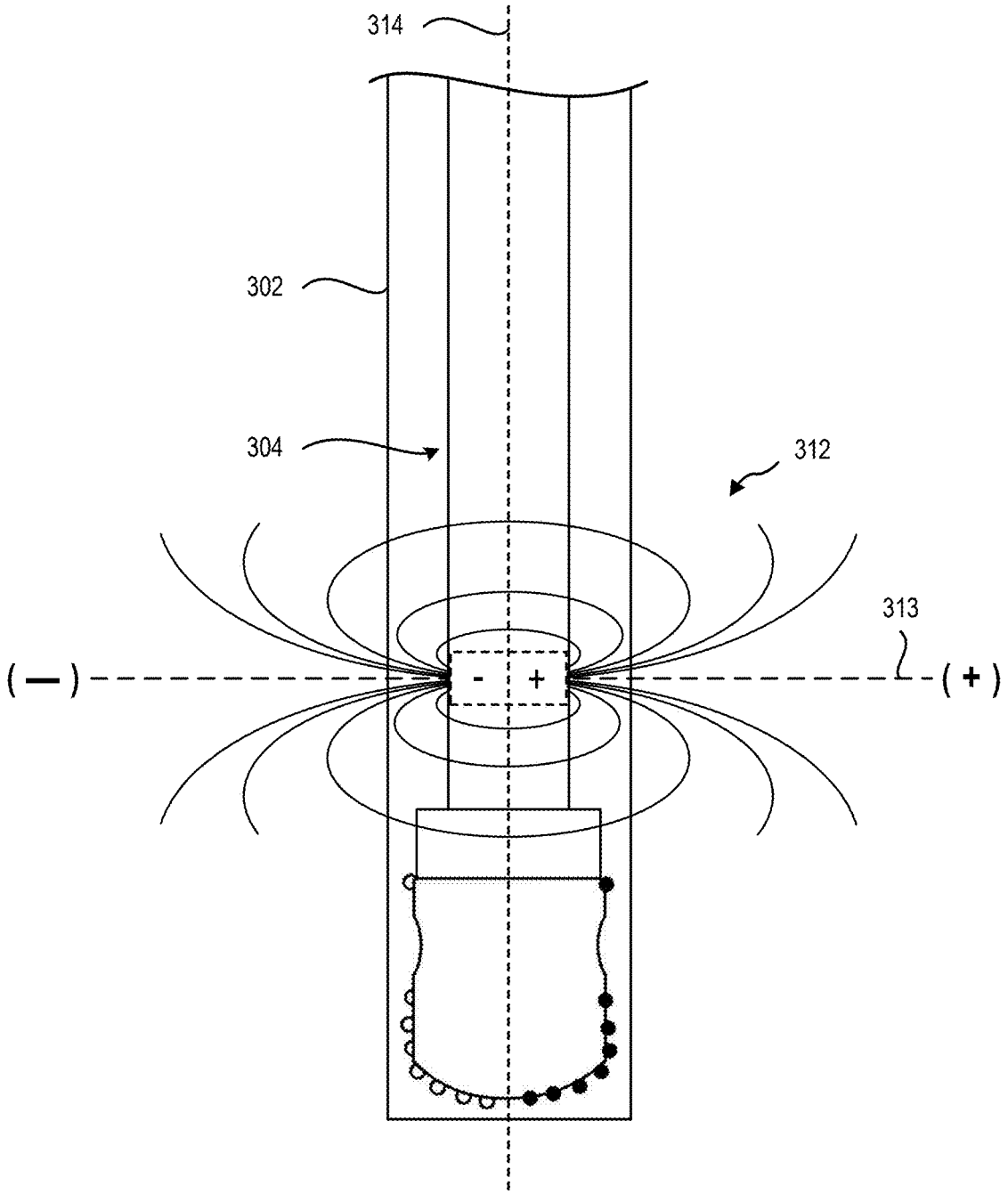
Figures 2, 3:
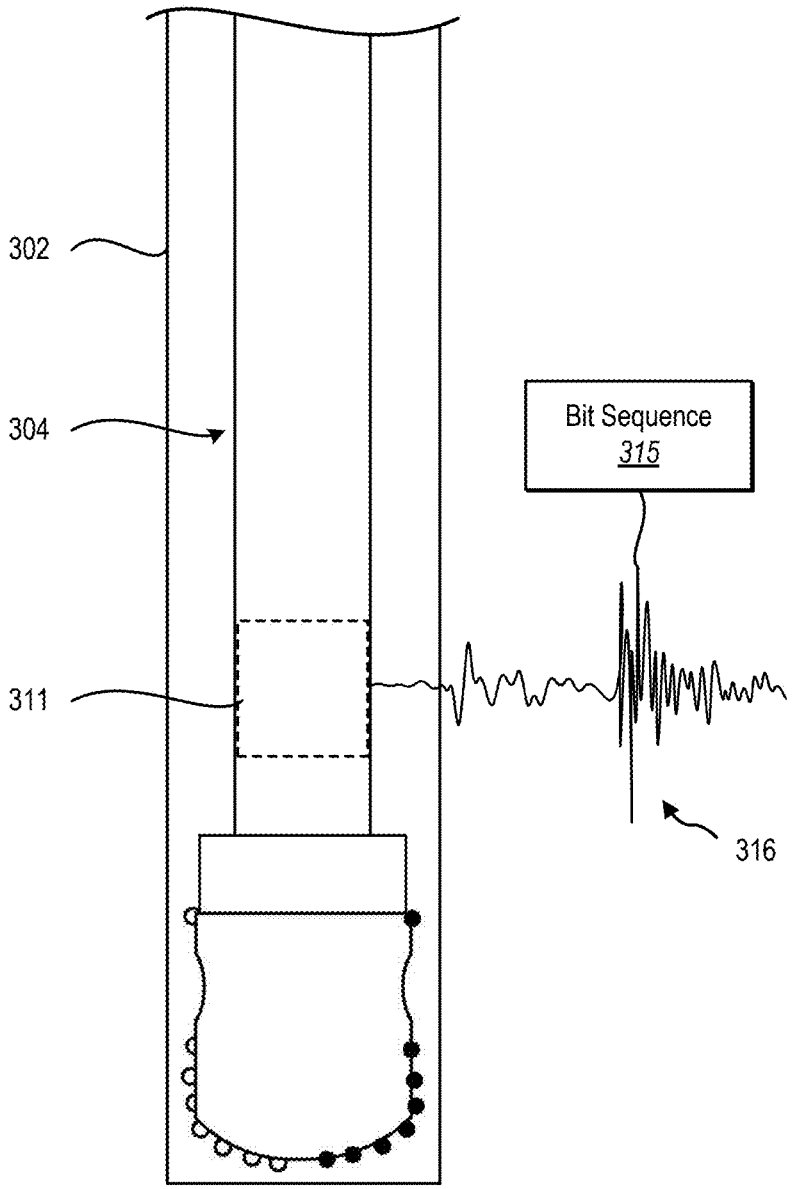
Figure 3:
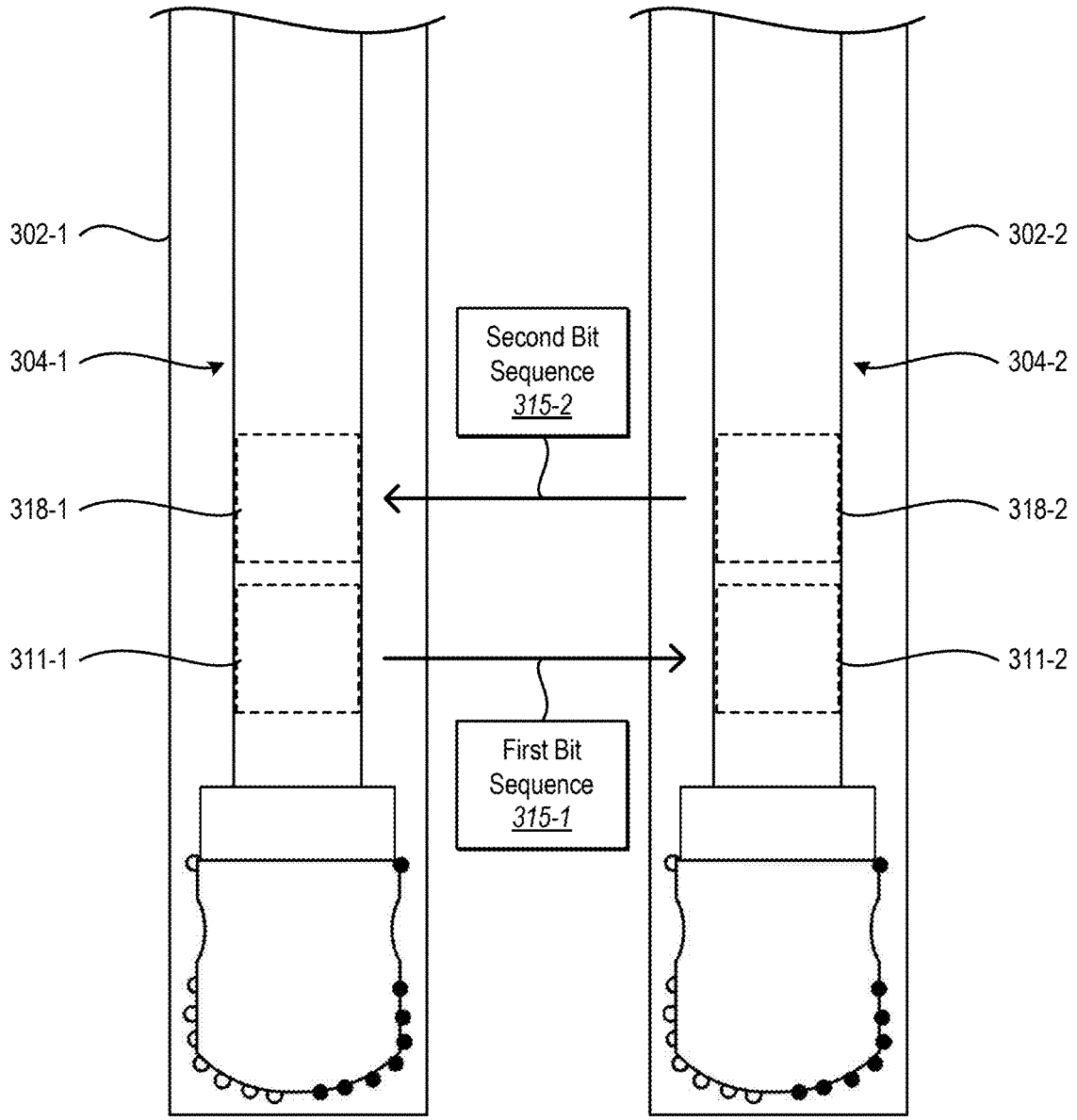

FIGS. 3-1 and 3-2 illustrate an example of a drilling tool assembly 304 including a magnetic component 311, according to at least one embodiment of the present disclosure. The drilling tool assembly 304 is implemented in a wellbore 302. As described herein, the magnetic component 311 may be implemented at any location of the drilling tool assembly 304, such as part of a BHA or uphole of a BHA of the drilling tool assembly 304.

The magnetic component 311 may generate, produce, and/or originate a polarized magnetic field 312. The polarized magnetic field 312 may be generated with respect to, or by virtue of, a positive-negative polarity 313 of the magnetic component 311. For example, the magnetic component 311 may include a permanent magnet such as a rare earth magnet, ferrite magnet, etc., for generating the polarized magnetic field 312. In another example, the magnetic component 311 may include an electromagnet for generating the polarized magnetic field 312. The polarity 313 (e.g., a direction of the positive and negative poles) may be oriented transverse to a longitudinal axis 314 of the drilling tool assembly 304, the BHA, the wellbore 302, etc. In some embodiments, the polarity 313 may be oriented substantially perpendicular to the longitudinal axis 314. In this way, the polarity 313 (e.g., positive and negative influences of the magnetic field) may extend outward from the magnetic component, the drilling tool assembly 304, etc., for example, through a subterranean formation.

In some embodiments, the polarity 313 may be somewhat aligned with the longitudinal axis 314. For example, the polarity 313 may extend substantially upward and downward along the longitudinal axis 314. This may facilitate, for example, transmitting information to the surface, transmitting information to one or more tools located uphole, or transmitting information transversely through a formation when the drilling tool assembly 304 is not oriented vertically (e.g. at an incline).

In some embodiments, the polarized magnetic field 312 may be relatively fixed with respect to the drilling tool assembly 304. For example, the polarity 313 may rotate about the longitudinal axis 314 based on a rotation of the drilling tool assembly 304. In another example, the polarized magnetic field 312 may move and/or rotate relative to the drilling tool assembly 304. For example, as described herein the polarized magnetic field 312 may be made (e.g., driven) to rotate independent of a rotation (or lack thereof) of the drilling tool assembly 304. In some embodiments, an orientation or angle of the polarity 313 with respect to the longitudinal axis 314 may be selectively movable, for example, to accommodate different orientations (e.g., inclination, azimuth, etc.) of the drilling tool assembly 304.

The polarized magnetic field 312 may facilitate communicating information about the drilling tool assembly 304 and/or the wellbore 302 to one or more other tools, such as one or more other drilling tool assemblies implemented in one or more other wellbores, one or more surface tools, etc. For example, one or more magnetic receivers may be configured to detect or sense the polarized magnetic field 312 originating from the magnetic component 311. A magnetic receiver may be part of an MWD tool, an LWD tool, RSS, smart drill bit, or other (e.g., dedicated) tool for detecting the polarized magnetic field 312.

Based on a magnetic receiver detecting the polarized magnetic field, the magnetic receiver may receive and/or determine various information about the drilling tool assembly 304 and/or the wellbore 302. For example, a magnetic receiver may determine a relative location and/or distance between the magnetic receiver and the magnetic component 311. For instance, the magnetic receiver may determine the relative location based on a magnitude or intensity of the polarized magnetic field 312 as detected by (e.g., at the location of) the magnetic receiver. In this way, the magnetic component 311 may be a ranging tool for facilitating identifying a range, distance, or location of the wellbore 302 with respect to one or more magnetic receivers (e.g., in another wellbore). The magnetic component in this manner may facilitate a passive communication of information (e.g., distance or ranging information) from the drilling tool assembly 304 to one or more other tools, such as to one or more other drilling tool assemblies implemented in one or more other wellbores. For example, this communication may be passive in that the ranging information (e.g., distance information) communicated via the polarized magnetic field 312 may be communicated passively, for example, without actively encoding information into the polarized magnetic field 312.

In some embodiments, the magnetic component 311 may be configured to actively communicate information from the drilling tool assembly 304 by modulating the polarized magnetic field 312. For example, the magnetic component 311 may be configured with or may be associated with one or more means for modulating the polarized magnetic field 312. Several means for modulating the polarized magnetic field are discussed herein (e.g., in connection with FIGS. 4-1 and 4-2). For instance, the polarized magnetic field 312 may be modulated by varying, changing, or otherwise manipulating a frequency of rotation of the magnetic field, an orientation of the polarity 313, the magnitude or intensity of the polarized magnetic field 312, and/or any other manner of modulating the polarized magnetic field and combinations thereof. In this way, a modulated polarized magnetic field 316 may be generated, as shown in FIG. 3-2.

The modulated polarized magnetic field 316 may be generated based on (e.g., to convey or carry) a bit sequence 315. For example, the magnetic component 311 and/or the means for modulating the polarized magnetic field may receive a bit sequence from a BHA or other component for transmitting information from the drilling tool assembly 304. The modulated polarized magnetic field 316 may be modulated to transmit the bit sequence 315. For example, the bit sequence 315 may be represented as a binary code (or other form of encoding), and the bit sequence 315 may be transmitted based on specific threshold frequencies (or changes in frequencies) of the rotation of the modulated polarized magnetic field 316. For instance, specific frequencies or frequency ranges may indicate 0's and 1's of a binary code. In another example, the bit sequence 315 may be transmitted based on specific orientations of the polarity 313 (e.g., orientations of the positive and negative poles). For instance, the positive and/or negative pole may be oriented in certain directions to represent 0's and 1's of a binary code. In another example, the bit sequence 315 may be transmitted based on a specific magnitude or intensity of the modulated polarized magnetic field 316. For example, specific threshold strengths (e.g., Teslas) or changes in strength of the modulated polarized magnetic field 316 may represent 0's and 1's of a binary code. The bit sequence 315 may be encoded into the modulated polarized magnetic field 316 based on any other technique for magnetic field modulation, including combinations with the foregoing.

In this way, the magnetic component 311 and/or the means for modulating the magnetic component may leverage the polarized magnetic field 312 to communicate more sophisticated information, for example, than passive ranging information. Further, in some embodiments, multiple magnetic components (e.g., including multiple polarized magnetic fields) and/or multiple means for modulating the polarized magnetic field may be implemented together to facilitate even more sophisticated modulation and/or encoding techniques as described herein. This may facilitate communicating more sophisticated and/or longer bit sequences, higher bandwidths, improved speed and reliability, etc.

In some embodiments, the modulated polarized magnetic fields may be implemented to facilitate bi-directional communication between a drilling tool assembly and another tool, such as another drilling tool assembly. FIG. 3-3 illustrates an example of bi-directional communication between a first drilling tool assembly 304-1 and a second drilling tool assembly 304-2, according to at least one embodiment of the present disclosure. The first drilling tool assembly 304-1 may be implemented in a first wellbore 302-1 and the second drilling tool assembly 304-2 may be implemented in a second wellbore 302-2.

The first drilling tool assembly 304-1 and the second drilling tool assembly 304-2 may be configured for bi-directional communication therebetween. For example, the first drilling tool assembly may include a first magnetic component 311-1 for generating a first polarized magnetic field. The first polarized magnetic field may propagate and/or emanate outward (e.g., transversely) from the first drilling tool assembly 304-1 such that it traverses the earth or a formation in which the first wellbore 302-1 is located. A first means for modulating the first polarized magnetic field may modulate the polarized magnetic field in one or more manners as described herein to encode a first bit sequence 315-1 into the first polarized magnetic field and in this way may transmit the first bit sequence 315-1 to the second drilling tool assembly 304-2 (and/or one or more other tools). The second drilling tool assembly 304-2 may include a second magnetic receiver 318-2 for detecting the (e.g., modulations of the) first polarized magnetic field and in this way may receive the first bit sequence 315-1.

In some embodiments, the second drilling tool assembly 304-2 may transmit a second bit sequence 315-2 to the first drilling tool assembly 304-1. For example, the second drilling tool assembly 304-2 may include a second magnetic component 311-2 which may facilitate generating and modulating a second polarized magnetic field for encoding the second bit sequence 315-2. The first drilling tool assembly 304-1 may include a first magnetic receiver 318-1 for detecting the second polarized magnetic field and receiving the second bit sequence 315-2. In this way, each of the first drilling tool assembly 304-1 and the second drilling tool assembly 304-2 may be configured to both send and receive transmissions via magnetic field modulation as described herein.

One or more bit sequences may be encoded into one or more modulated polarized magnetic fields as described herein to transmit any information from a corresponding drilling tool assembly. For example, a bit sequence may transmit information associated with surface and/or downhole measurements, drilling logs, drilling parameters, status information, instructions or commands, or any other information accessible to any component of the drilling tool assembly.

In some embodiments, a bit sequence may transmit drilling parameters of the drilling tool assembly. For example, the drilling parameters may indicate surface and/or downhole rotational speed (RPM), weight on bit (WOB), surface and/or downhole torque (TOR), pressure, temperature, flow rate, rate of penetration (ROP), or any other drilling parameters. In some embodiments, the drilling parameters may indicate information regarding the steering or directional drilling of the drilling tool assembly (e.g., of the BHA). For example, the bit sequence may indicate a steering mode and/or associated steering parameters of the drilling tool assembly, such as an azimuth and/or inclination of the drilling tool assembly.

Communicating steering information in this way may facilitate forming parallel wellbores. For example, when forming parallel wellbores it may be desirable to maintain a predetermined distance between the wellbores to avoid the wellbores intersecting, or conversely, it may be desirable to intersect wellbores to join the wellbores. Communicating information from one drilling tool assembly to another via the modulated polarized magnetic field as described herein may facilitate making steering decisions for one or more of the wellbores. For example, a steering command may be transmitted (e.g., via downlink) to one drilling tool assembly, and the drilling tool assembly may transmit the command (or complimentary command) to another drilling tool assembly. In another example, communication via the bit sequence may facilitate semi-autonomous or fully-autonomous steering and/or drilling for one or more wellbores. For example, one or more BHAs may carry out plans or instructions based on communication with another, parallel BHAs, which may reduce or eliminate the need to send downlinks to one or more of the BHAs. This may improve the speed, accuracy, quality, etc., of the downhole operations as downlinks may often be disruptive to downhole operations. In some embodiments, one BHA may be implemented to guide or control one or more other BHAs in this way, such as a master BHA carrying out steering plans or instructions and communicating information to other BHAs to mirror or follow in a similar manner. Communication from the magnetic component via the modulated polarized magnetic field may be contemplated in any number of ways and for any number of purposes in order to improve one or more downhole operations. Indeed, the downhole communication techniques described herein may be implemented to communicate any relevant information via the modulated polarized magnetic field.

Bit sequences may be transmitted in any direction, and in any orientation through the techniques described herein. For example, the orientation of the polarity may be manipulated and/or controlled in order to direct the transmission of the polarized magnetic field toward a specific target, such as toward another drilling tool assembly or well, toward the surface, or in any other direction. In some embodiments, the magnetic component may be configured to generate a polarized magnetic field that penetrates a certain distance or length through an underground formation. For example, the communication techniques described herein may facilitate communication through an underground formation up to 50 meters, 75 meters, 100 meters, 125 meters, or 150 meters. In this way, the generation and modulation of the polarized magnetic field may facilitate communication, for example, between two BHAs that are separated by up to 100 meters or more.

As described herein, the communication techniques of the present disclosure may be achieved by modulating a polarized magnetic field generated by a magnetic component, and the modulation may be facilitated based on one or more means for modulating the polarized magnetic field. Several means are described herein, although it is contemplated that the communication techniques described herein may be accomplished by any modulation to the polarized magnetic field through any sufficient means.

In some embodiments, the means for modulating the polarized magnetic field may include one or more separate components, structures, systems, and/or devices for interacting with, interfacing with, manipulating, or otherwise controlling the magnetic component. In some embodiments, the means for modulating the polarized magnetic field may be incorporated as part of the magnetic component.

Figures 1, 4:
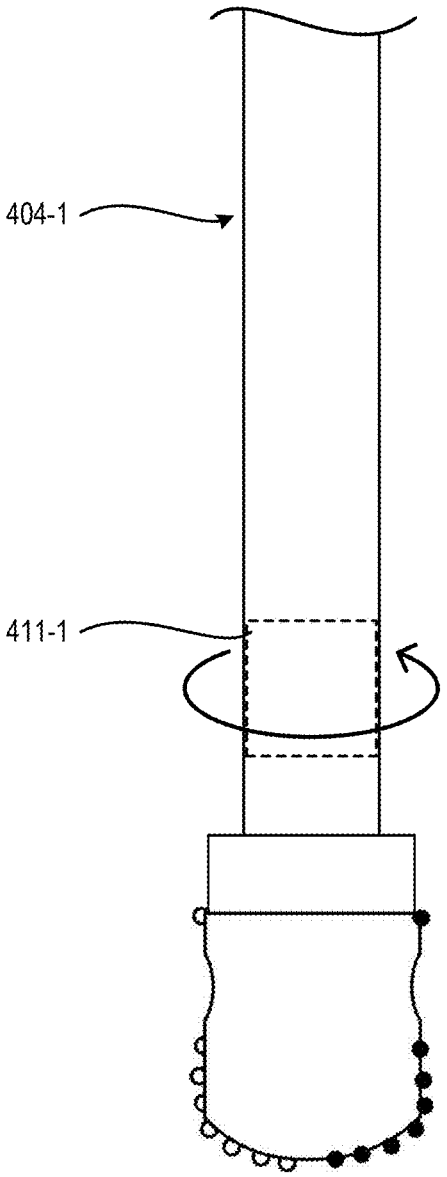
Figures 2, 4:
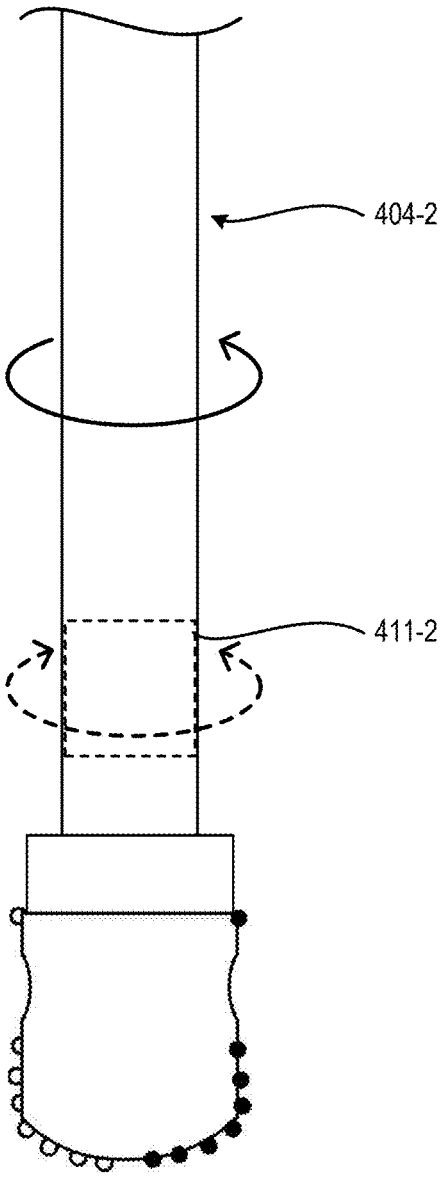

In some embodiments, the means for modulating the polarized magnetic field is implemented to modulate (and encode a bit sequence into) the magnetic field through a rotation of the magnetic field and/or of the magnetic component. For example, as described herein, the polarized magnetic field may be rotated at one or more specific frequencies or changes in frequencies to represent bits of a bit sequence. FIGS. 4-1 and 4-2 illustrate examples of modulating the polarized magnetic field through rotation, according to embodiments of the present disclosure.

In some embodiments, the polarized magnetic field may be rotated based on (e.g., dependent on) rotating one or more components or portions of the drilling tool assembly. For example, as shown in FIG. 4-1, a magnetic component 411-1 may be fixed at a location on a drilling tool assembly 404-1, and the magnetic component 411-1 may rotate with the associated portion(s) of the drilling tool assembly 404-1 to which it is fixed. For instance, the magnetic component 411-1 may be a dedicated magnetic sub which may be connected or fixed between two sections of drill pipe, between components of the BHA, or between any other portions of the drilling tool assembly 404-1. In some embodiments, the magnetic component 411-1 may not necessarily be a dedicated magnetic sub, but may be implemented as one or more magnets (e.g., permanent magnets and/or electromagnets) included in or as part of another component of the drilling tool assembly 404-1. For example, one or more magnets may be positioned on, within, or incorporated with a component of the BHA, on a drill pipe, in a collar, on a drill bit, or any other component of the drilling tool assembly 404-1. The magnetic component 411-1 may include one magnet or may be multiple magnets, for example, to achieve a desired intensity, orientation, directionality, shape, and/or form of the polarized magnetic field.

In some embodiments, the polarized magnetic field may be modulated based on modulating a surface RPM of the drilling tool assembly. For example, the magnetic component 411-1 may be fixed to any portion of the drilling tool assembly 404-1 as described herein, and a top drive of the downhole system may be made to rotate at a specific frequency which in turn may change the frequency with which the magnetic component 411-1 rotates, thereby imparting a desired rotation of the polarized magnetic field. In some embodiments, the polarized magnetic field may be modulated based on modulating a downhole RPM of a downhole motor. For example, the magnetic component 411-1 may be fixed to a portion of a downhole motor, BHA, or other component downhole of the downhole motor, and the downhole motor may be made to rotate at a specific frequency (with or without respect to a surface RPM) which in turn may change the frequency with which the magnetic component 411-1 rotates, thereby imparting a desired rotation of the polarized magnetic field. In some embodiments, the polarized magnetic field may be modulated based on modulating the surface RPM and/or downhole RPM by intentionally breaking or stalling a rotation of the drilling tool assembly 404-1 or downhole motor. For example, the means for modulating the polarized magnetic field may include a stabilizer or engagement controller for selectively controlling the engagement or disengagement of a stabilizer or other engagement member with the wellbore wall which may temporarily or permanently alter the frequency of rotation of the polarized magnetic field. In another example, the means for modulating the polarized magnetic field may include a weight controller for selectively increasing or decreasing a WOB as applied to a bit and/or a reamer to temporarily or permanently alter the frequency of rotation of the polarized magnetic field. In this way, the polarized magnetic field may be rotationally fixed to one or more portions of the drilling tool assembly 404-1 and the means for modulating the polarized magnetic field may be implemented as various forms of changing the frequency with which the drilling tool assembly (or a portion thereof) rotates.

In some embodiments, the polarized magnetic field may be rotated independent of a rotation of one or more portions of the drilling tool assembly. For example, as shown in FIG. 4-2 some or all of a drilling tool assembly 404-2 may rotate, and a magnetic component 411-2 may rotate irrespective of the rotation (or lack thereof) of the drilling tool assembly 404-2. For example, a mechanical assembly may rotate the magnetic component 411-2 relative to the drilling tool assembly 404-2. For instance, a means for modulating the polarized magnetic field may include an electric motor, hydraulic motor, gyroscopic component, rotational actuator, etc., for controlling an independent rotation of the magnetic component 411-2.

In accordance with at least one embodiment of the present disclosure, the drilling tool assembly 404-2 (e.g., a steering system of the drilling tool assembly 404-2 such as an RSS) may include a roll-stabilize platform that may be configured to rotate independent of a rotation of the drilling tool assembly 404-2, such as to facilitate steering operations. For example, the roll-stabilize platform may include gyroscopic and other stabilizing mechanisms that accommodate or compensate for the rotational movement of the drilling tool assembly while maintaining the orientation of a specific tool or instrument. In some embodiments, the magnetic component 411-2 may be implemented as part of, or in connection with, a roll-stabilize platform (e.g., a roll-stabilize platform of an existing system of the drilling tool assembly 404-2)

and the roll-stabilize platform may be implemented to rotate the magnetic component 411-2 independent of the drilling tool assembly 404-2.

In some embodiments, the polarized magnetic field may be made to rotate independent of a rotation of the magnetic component 411-1. In this way the rotation of the polarized magnetic field may not necessarily be achieved based on rotating the magnetic component, but may be achieved based on driving a rotation of the polarized magnetic field itself. For example, in some embodiments the polarized magnetic field may be generated by an electromagnet having one or more field coils. In some embodiments the magnetic component may have several field coils at different orientations such that, by periodically energizing different field coils, a rotating magnetic field may be generated. For example, a multi-phase electrical energy input may be applied to the field coils (e.g., such as in an induction motor) at a specific frequency to produce a rotating magnetic field. The electrical energy input to the electromagnet may, in this way, be controlled to rotate the magnetic field at a specific frequency or change in frequency, with or without respect to a rotation of the magnetic component 411-2 and/or the drilling tool assembly 404-2.

In this way, the polarized magnetic field may be modulated based on modulating a rotation of the polarized magnetic field through any of the means described herein, or any other suitable means. Additionally, while the means for modulating the rotation of the polarized magnetic field have been primarily described with respect to achieving a specific frequency of rotation (e.g., frequency with respect to a global reference frame or with respect to the formation), it should be understood that any of the rotational means described herein may be applicable to achieve modulation of the polarized magnetic field by orienting a polarity of the magnetic field. For example, the rotational means described herein may be implemented to rotate the polarized magnetic field with respect to a rotation of the drilling tool assembly (or lack thereof) and thereby maintain the polarity oriented in a substantially fixed orientation with respect to a global reference frame (e.g., temporarily). Bits of a bit sequence, for example, may be represented by alternatingly orienting a specific pole of the polarized magnetic field in this way.

In some embodiments, the means for modulating the polarized magnetic field may include a means for controlling or varying the intensity or strength of the polarized magnetic field. For example, the electrical energy input to an electromagnet may be modified to vary the strength of the resulting polarized magnetic field. In another example, the means may include a device, material, or component for altering the strength of the polarized magnetic field (e.g., permanent or electromagnet) by shielding, concealing, or masking the polarized magnetic field. For instance, the means may implement barriers of non-magnetically penetrable materials, other magnetic fields, anti-magnetic materials, etc. to selectively inhibit the propagation of the polarized magnetic field to varying degrees from the magnetic component.

In this way, the polarized magnetic field may be modulated based on a rotation of the magnetic field, based on an oriented polarity of the magnetic field, based on a strength of the magnetic field, or based on any other form of modulation. In some embodiments, multiple magnetic components and/or multiple forms of magnetic field modulation may be implemented, for example, to achieve more sophisticated communication. For example, by modulating two or more polarized magnetic fields independently and/or by modulating two or more properties of a polarized magnetic field, communication may be facilitated through higher-order, more robust, or otherwise more sophisticated encoding techniques. For instance, a first magnetic component may be implemented on the BHA and modulated based on a downhole RPM and a surface RPM, and a second magnetic component may be implemented above the BHA (e.g., above a downhole motor) and may be modulated based only on the surface RPM. In another example, a polarized magnetic field may be driven to rotate at several different frequencies (e.g., including forward and backward) to facilitate communication over higher-order encodings (e.g., ternary, quaternary, etc.). In another example, the rotation and the intensity of the polarized magnetic field may both be modulated in conjunction to communicate more sophisticated information.

In some embodiments, a drilling tool assembly may include multiple magnetic components (and associated means for modulating) at different locations of the drilling tool assembly. For example, in some cases, a magnetic receiver may be configured to detect and/or receive a polarized magnetic field based on the magnetic receiver being substantially aligned, at a same depth as, or otherwise in a complimentary position to the magnetic component (e.g., of another drilling tool assembly). Thus, in some cases if the alignment (e.g., depth) of the magnetic component and the magnetic receiver do not match, communication may be limited or unavailable. In some embodiments, the drilling tool assembly includes multiple magnetic components (e.g., at any location of the drilling tool assembly) for providing better alignment of one or more polarized magnetic fields for propagation to a magnetic receiver.

Figure 5:
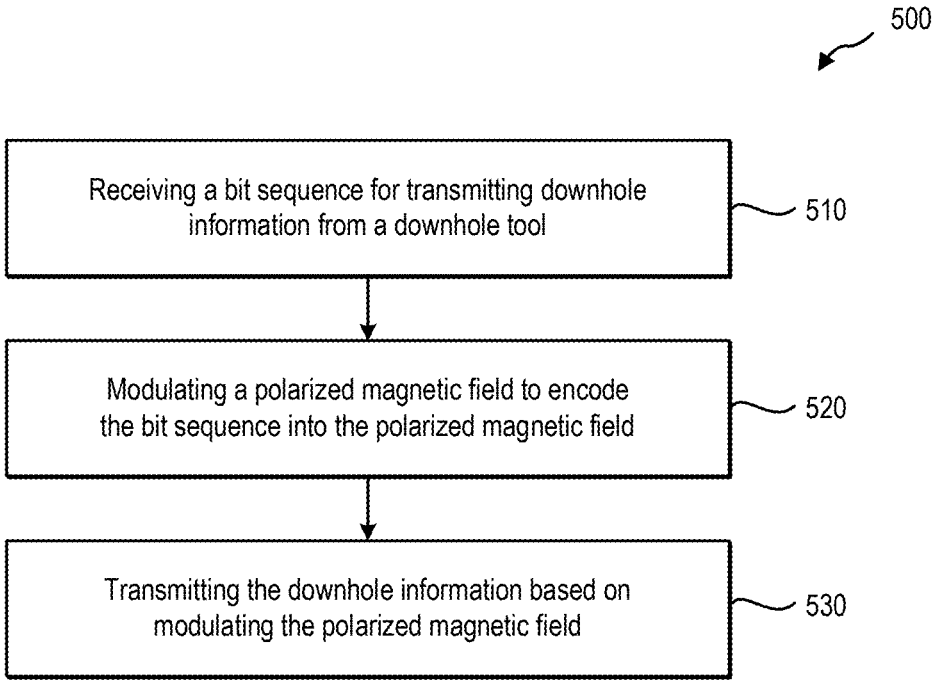
FIG. 5 illustrates a flow diagram for a method or a series of acts for downhole communication as described herein, according to at least one embodiment of the present disclosure.

FIG. 5 illustrates a flow diagram for a method 500 or a series of acts for downhole communication as described herein, according to at least one embodiment of the present disclosure. While FIG. 5 illustrates acts according to one embodiment, alternative embodiments may add to, omit, reorder, or modify any of the acts of FIG. 5.

In some embodiments, the method 500 includes an act 510 of receiving a bit sequence for transmitting downhole information from a downhole tool implemented in a wellbore.

In some embodiments, the method 500 includes an act 520 of modulating a polarized magnetic field to encode the bit sequence into the polarized magnetic field. For example, the polarized magnetic field may be generated by a magnetic component associated with the downhole tool. For example, the magnetic component may generate the polarized magnetic field with a permanent magnet. In another example, the magnetic component may generate the polarized magnetic field with an electromagnet.

In some embodiments, the polarized magnetic field is modulated based on modulating a rotation of the polarized magnetic field. For example, modulating a rotation of the magnetic component may modulate the polarized magnetic field. The rotation of the magnetic component may be modulated based on modulating a surface RPM of the downhole tool. The rotation of the magnetic component may be modulated based on modulating a downhole RPM of a downhole motor associated with the downhole tool. The rotation of the magnetic component may be modulated based on controlling a WOB associated with the downhole tool to change an RPM of the downhole tool. The rotation of the modulating component may be modulated based on controlling one or more engagement members for engaging a wall of the wellbore to change an RPM of the downhole tool.

In some embodiments, the rotation of the magnetic component is modulated based on rotating the magnetic component relative to the downhole tool. For example, the magnetic component may be rotated based on rotating a roll-stabilize platform of the downhole tool relative to a rotation of the downhole tool. In some embodiments, the polarized magnetic field may be rotated and modulated based on controlling a multi-phase electrical energy input to the magnetic component.

In some embodiments, a polarity of the polarized magnetic field is oriented transverse to a longitudinal axis of the downhole tool and modulating the rotation of the polarized magnetic field includes rotating the polarity about the longitudinal axis. In some embodiments, the polarized magnetic field may be modulated based on selectively rotationally orienting the polarity of the polarized magnetic field. In some embodiments, the polarized magnetic field may be modulated based on modulating a strength of the polarized magnetic field.

In some embodiments, the method 500 includes an act 530 of transmitting the downhole information based on modulating the polarized magnetic field. In some embodiments, transmitting the downhole information includes transmitting steering information of the downhole tool including one or more of an azimuth or an inclination of the downhole tool.

In some embodiments, the method 500 includes generating the bit sequence at a first downhole tool implemented in a first wellbore for transmitting the downhole information from the first downhole tool; modulating the polarized magnetic field to encode the bit sequence into the polarized magnetic field, wherein the polarized magnetic field is generated by a magnetic component of the first downhole tool; transmitting the downhole information from the first downhole tool based on modulating the polarized magnetic field; and receiving the downhole information at a second downhole tool based on detecting the modulated polarized magnetic field with a magnetic receiver of the second downhole tool. For example, the second downhole tool may be implemented in a second wellbore, and the downhole information may indicate one or more steering parameters of the first downhole tool. The method may further include adjusting one or more steering parameters of the second downhole tool based on receiving the downhole information. In some embodiments, the modulated polarized magnetic field may be detected by the second downhole tool up to 100 meters from the first downhole tool.

In some embodiments, the method 500 includes generating a first bit sequence at a first downhole tool implemented in a first wellbore for transmitting first downhole information from the first downhole tool; modulating a first polarized magnetic field to encode the first bit sequence into the first polarized magnetic field; transmitting the first downhole information from the first downhole tool based on modulating the first polarized magnetic field; receiving the first downhole information at a second downhole tool implemented in a second wellbore based on detecting the first modulated polarized magnetic field; generating a second bit sequence at the second downhole tool for transmitting the second downhole information from the second downhole tool; modulating a second polarized magnetic field to encode the second bit sequence into the second polarized magnetic field; transmitting the second downhole information from the second downhole tool based on modulating the second polarized magnetic field; and receiving the second downhole information at the first downhole tool based on detecting the second modulated polarized magnetic field.

In some embodiments, an example of a downhole system is described for drilling an earth formation to form a wellbore. The downhole system includes a drill rig used to turn a drilling tool assembly which extends downward into the wellbore. The drilling tool assembly may include a drill string, a BHA, and a bit, attached to the downhole end of the drill string.

The drill string may include several joints of drill pipe connected end-to-end through tool joints. The drill string transmits drilling fluid through a central bore and transmits rotational power from the drill rig to the BHA. In some embodiments, the drill string further includes additional downhole drilling tools and/or components such as subs, pup joints, etc. The drill pipe provides a hydraulic passage through which drilling fluid is pumped from the surface. The drilling fluid discharges through selected-size nozzles, jets, or other orifices in the bit for the purposes of cooling the bit and cutting structures thereon, and for lifting cuttings out of the wellbore as it is being drilled.

The BHA may include the bit, other downhole drilling tools, or other components. An example BHA may include additional or other downhole drilling tools or components (e.g., coupled between the drill string and the bit). Examples of additional BHA components include drill collars, stabilizers, measurement-while-drilling ("MWD") tools, logging-while-drilling ("LWD") tools, downhole motors, underreamers, section mills, hydraulic disconnects, jars, vibration or dampening tools, other components, or combinations of the foregoing.

In general, the downhole system may include other downhole drilling tools, components, and accessories such as special valves (e.g., kelly cocks, blowout preventers, and safety valves). Additional components included in the downhole system may be considered a part of the drilling tool assembly, the drill string, or a part of the BHA, depending on their locations in the downhole system.

The bit in the BHA may be any type of bit suitable for degrading downhole materials. For instance, the bit may be a drill bit suitable for drilling the earth formation. Example types of drill bits used for drilling earth formations are fixed-cutter or drag bits. In other embodiments, the bit may be a mill used for removing metal, composite, elastomer, other materials downhole, or combinations thereof. For instance, the bit may be used with a whipstock to mill into casing lining the wellbore. The bit may also be a junk mill used to mill away tools, plugs, cement, other materials within the wellbore, or combinations thereof. Swarf or other cuttings formed by use of a mill may be lifted to the surface or may be allowed to fall downhole. The bit may include one or more cutting elements for degrading the earth formation.

The BHA may further include steering components such as a rotary steerable system (RSS). The RSS may include directional drilling tools that change a direction of the bit, and thereby the trajectory of the wellbore. At least a portion of the RSS may maintain a geostationary position relative to an absolute reference frame, such as one or more of gravity, magnetic north, or true north. Using measurements obtained with the geostationary position, the RSS may locate the bit, change the course of the bit, and direct the directional drilling tools on a projected trajectory. The RSS may steer the bit in accordance with or based on a trajectory for the bit. For example, a trajectory may be determined for directing the bit toward one or more subterranean targets such as an oil or gas reservoir.

In some embodiments, the downhole system includes a magnetic component. The magnetic component may be configured to generate and/or modulate a polarized magnetic field such that the downhole system may communicate information via the magnetic component (e.g., via the polarized magnetic field), for example, from the BHA of the downhole system. For example, the magnetic component may include, or may be associated with, a means for modulating the polarized magnetic field in order to encode a bit sequence into the polarized magnetic field as described herein. In some embodiments, the magnetic component may be, or may be part of, a ranging tool or ranging component of the downhole system. In some embodiments, a downhole system (e.g., the downhole system or another downhole system, BHA, downhole tool, etc.) may be equipped with a magnetic receiver for receiving information as encoded bit sequences in a polarized magnetic field. For example, the magnetic receiver may be part of an MWD tool, LWD tool, ranging tool, or may be a dedicated tool for receiving communications via a modulated polarized magnetic field. In this way, the downhole system may be configured to communicate (e.g., uni- or bi-directional communication) by transmitting and/or receiving signals through a polarized magnetic field.

In some embodiments, a downhole system may be implemented to form a wellbore in an oilfield or borefield with respect to another wellbore. In some embodiments, a downhole system includes a first wellbore and a second wellbore positioned with respect to each other, according to at least one embodiment of the present disclosure. For example, the wellbores may be adjacent or parallel wellbores. The wellbores may be two wellbores of a borefield (e.g., of many wellbores), such as for a geothermal energy application. The wellbores may be wellbores in an oilfield that are positioned close to each other such as to access a similar formation or subterranean target. The wellbores may be wellbores that are otherwise positioned relative to each other for any other purpose.

A first drilling tool assembly having a first BHA may be implemented to drill, form, and/or modify the first wellbore and a second drilling tool assembly having a second BHA may be implemented to drill, form, and/or modify the second wellbore. The first wellbore and second wellbore may be drilled, formed, and/or modified at the same time or at different times. For example, in some cases, such as when forming wellbores for a borefield for accessing geothermal resources, two or more wellbores may be formed at the same (or at least somewhat overlapping) time. In another example, one wellbore may be formed with respect to another (e.g., already formed) wellbore. For the purposes of discussion, the first wellbore and second wellbore and/or components corresponding to a respective wellbore may be described as "parallel," such as parallel wellbores, parallel BHAs, etc. It should be understood that this description of components being "parallel" is for ease of discussion and should be understood as referring to associated components that are positioned relative to one another without requiring that the components be aligned or oriented in a strictly parallel configuration. For example, the first wellbore and the second wellbore may be parallel wellbores in that they are positioned and/or oriented with respect to each other, while not necessarily being parallel in a geometric sense.

In some embodiments, while forming a wellbore with respect to another (e.g., parallel) wellbore, it may be advantageous to locate a relative position of one or both wellbores. For instance, it may be desirable to prevent the wellbores from intersecting or to maintain a certain distance between the wellbores. In other cases, it may be desirable to join or intersect a wellbore with another wellbore at one or more locations. Thus, it may be advantageous to locate the relative locations of parallel wellbores. This may be accomplished in many ways. For example, a drill plan may outline a trajectory for a wellbore to follow and/or may outline the actual trajectory of a wellbore. One or more measurements may be collected for measuring and/or mapping the geometry of a wellbore. In some cases, however, tracking or determining the geometry or trajectory of a wellbore in these ways may be unreliable, inaccurate, or otherwise unavailable.

In some embodiments, a downhole system may include tool(s) implemented downhole for detecting and/or measuring the location, position, and/or relative distance of another wellbore. For example, a downhole system may include one or more magnetic components for facilitating determining a location of one or more wellbores. One or more of the first drilling tool assembly or the second drilling tool assembly may include a magnetic component. The magnetic component may be included as part of the BHA, at a location uphole of the BHA, or at any other location of the drilling tool assembly. The magnetic component may be implemented as a ranging tool for (e.g., passively) determining the range between wellbores. The magnetic component may be implemented as a communication component for (e.g., actively) communicating information (e.g., bit sequences) between parallel wellbores, parallel BHAs, etc., (e.g., uni- or bi-directional communication). In some embodiments, the magnetic component may include or may be associated with (e.g., implemented with) a magnetic receiver for detecting magnetic signals from a magnetic component (e.g., implemented in a parallel wellbore).

In some embodiments, a drilling tool assembly includes a magnetic component, according to at least one embodiment of the present disclosure. The drilling tool assembly is implemented in a wellbore. As described herein, the magnetic component may be implemented at any location of the drilling tool assembly, such as part of a BHA or uphole of a BHA of the drilling tool assembly.

The magnetic component may generate, produce, and/or originate a polarized magnetic field. The polarized magnetic field may be generated with respect to, or by virtue of, a positive-negative polarity of the magnetic component. For example, the magnetic component may include a permanent magnet such as a rare earth magnet, ferrite magnet, etc., for generating the polarized magnetic field. In another example, the magnetic component may include an electromagnet for generating the polarized magnetic field. The polarity (e.g., a direction of the positive and negative poles) may be oriented transverse to a longitudinal axis of the drilling tool assembly, the BHA, the wellbore, etc. In some embodiments, the polarity may be oriented substantially perpendicular to the longitudinal axis. In this way, the polarity (e.g., positive and negative influences of the magnetic field) may extend outward from the magnetic component, the drilling tool assembly, etc., for example, through a subterranean formation.

In some embodiments, the polarity may be somewhat aligned with the longitudinal axis. For example, the polarity may extend substantially upward and downward along the longitudinal axis. This may facilitate, for example, transmitting information to the surface, transmitting information to one or more tools located uphole, or transmitting information transversely through a formation when the drilling tool assembly is not oriented vertically (e.g. at an incline).

In some embodiments, the polarized magnetic field may be relatively fixed with respect to the drilling tool assembly. For example, the polarity may rotate about the longitudinal axis based on a rotation of the drilling tool assembly. In another example, the polarized magnetic field may move and/or rotate relative to the drilling tool assembly. For example, as described herein, the polarized magnetic field may be made (e.g., driven) to rotate independent of a rotation (or lack thereof) of the drilling tool assembly. In some embodiments, an orientation or angle of the polarity with respect to the longitudinal axis may be selectively movable, for example, to accommodate different orientations (e.g., inclination, azimuth, etc.) of the drilling tool assembly.

The polarized magnetic field may facilitate communicating information about the drilling tool assembly and/or the wellbore to one or more other tools, such as one or more other drilling tool assemblies implemented in one or more other wellbores, one or more surface tools, etc. For example, one or more magnetic receivers may be configured to detect or sense the polarized magnetic field originating from the magnetic component. A magnetic receiver may be part of an MWD tool, an LWD tool, an RSS, a smart drill bit, or other (e.g., dedicated) tool for detecting the polarized magnetic field.

Based on a magnetic receiver detecting the polarized magnetic field, the magnetic receiver may receive and/or determine various information about the drilling tool assembly and/or the wellbore. For example, a magnetic receiver may determine a relative location and/or distance between the magnetic receiver and the magnetic component. For instance, the magnetic receiver may determine the relative location based on a magnitude or intensity of the polarized magnetic field as detected by (e.g., at the location of) the magnetic receiver. In this way, the magnetic component may be a ranging tool for facilitating identifying a range, distance, or location of the wellbore with respect to one or more magnetic receivers (e.g., in another wellbore). The magnetic component in this manner may facilitate a passive communication of information (e.g., distance or ranging information) from the drilling tool assembly to one or more other tools, such as to one or more other drilling tool assemblies implemented in one or more other wellbores. For example, this communication may be passive in that the ranging information (e.g., distance information) communicated via the polarized magnetic field may be communicated passively, for example, without actively encoding information into the polarized magnetic field.

In some embodiments, the magnetic component may be configured to actively communicate information from the drilling tool assembly by modulating the polarized magnetic field. For example, the magnetic component may be configured with or may be associated with one or more means for modulating the polarized magnetic field. Several means for modulating the polarized magnetic field are discussed herein. For instance, the polarized magnetic field may be modulated by varying, changing, or otherwise manipulating a frequency of rotation of the magnetic field, an orientation of the polarity, the magnitude or intensity of the polarized magnetic field, and/or any other manner of modulating the polarized magnetic field and combinations thereof. In this way, a modulated polarized magnetic field may be generated.

The modulated polarized magnetic field may be generated based on (e.g., to convey or carry) a bit sequence. For example, the magnetic component and/or the means for modulating the polarized magnetic field may receive a bit sequence from a BHA or other component for transmitting information from the drilling tool assembly. The modulated polarized magnetic field may be modulated to transmit the bit sequence. For example, the bit sequence may be represented as a binary code (or other form of encoding), and the bit sequence may be transmitted based on specific threshold frequencies (or changes in frequencies) of the rotation of the modulated polarized magnetic field. For instance, specific frequencies or frequency ranges may indicate 0's and 1's of a binary code. In another example, the bit sequence may be transmitted based on specific orientations of the polarity (e.g., orientations of the positive and negative poles). For instance, the positive and/or negative pole may be oriented in certain directions to represent 0's and 1's of a binary code. In another example, the bit sequence may be transmitted based on a specific magnitude or intensity of the modulated polarized magnetic field. For example, specific threshold strengths (e.g., Teslas) or changes in strength of the modulated polarized magnetic field may represent 0's and 1's of a binary code. The bit sequence may be encoded into the modulated polarized magnetic field based on any other technique for magnetic field modulation, including combinations with the foregoing.

In this way, the magnetic component and/or the means for modulating the magnetic component may leverage the polarized magnetic field to communicate more sophisticated information, for example, than passive ranging information. Further, in some embodiments, multiple magnetic components (e.g., including multiple polarized magnetic fields) and/or multiple means for modulating the polarized magnetic field may be implemented together to facilitate even more sophisticated modulation and/or encoding techniques as described herein. This may facilitate communicating more sophisticated and/or longer bit sequences, higher bandwidths, improved speed and reliability, etc.

In some embodiments, the modulated polarized magnetic fields may be implemented to facilitate bi-directional communication between a drilling tool assembly and another tool, such as another drilling tool assembly. In some embodiments, bi-directional communication between a first drilling tool assembly and a second drilling tool assembly is described herein. The first drilling tool assembly may be implemented in a first wellbore and the second drilling tool assembly may be implemented in a second wellbore.

The first drilling tool assembly and the second drilling tool assembly may be configured for bi-directional communication therebetween. For example, the first drilling tool assembly may include a first magnetic component for generating a first polarized magnetic field. The first polarized magnetic field may propagate and/or emanate outward (e.g., transversely) from the first drilling tool assembly such that it traverses the earth or a formation in which the first wellbore is located. A first means for modulating the first polarized magnetic field may modulate the polarized magnetic field in one or more manners as described herein to encode a first bit sequence into the first polarized magnetic field and in this way may transmit the first bit sequence to the second drilling tool assembly (and/or one or more other tools). The second drilling tool assembly may include a second magnetic receiver for detecting the (e.g., modulations of the) first polarized magnetic field and in this way may receive the first bit sequence.

In some embodiments, the second drilling tool assembly may transmit a second bit sequence to the first drilling tool assembly. For example, the second drilling tool assembly may include a second magnetic component which may facilitate generating and modulating a second polarized magnetic field for encoding the second bit sequence. The first drilling tool assembly may include a first magnetic receiver for detecting the second polarized magnetic field and receiving the second bit sequence. In this way, each of the first drilling tool assembly and the second drilling tool assembly may be configured to both send and receive transmissions via magnetic field modulation as described herein.

One or more bit sequences may be encoded into one or more modulated polarized magnetic fields as described herein to transmit any information from a corresponding drilling tool assembly. For example, a bit sequence may transmit information associated with surface and/or downhole measurements, drilling logs, drilling parameters, status information, instructions or commands, or any other information accessible to any component of the drilling tool assembly.

In some embodiments, a bit sequence may transmit drilling parameters of the drilling tool assembly. For example, the drilling parameters may indicate surface and/or downhole rotational speed (RPM), weight on bit (WOB), surface and/or downhole torque (TOR), pressure, temperature, flow rate, rate of penetration (ROP), or any other drilling parameters. In some embodiments, the drilling parameters may indicate information regarding the steering or directional drilling of the drilling tool assembly (e.g., of the BHA). For example, the bit sequence may indicate a steering mode and/or associated steering parameters of the drilling tool assembly, such as an azimuth and/or inclination of the drilling tool assembly.

Communicating steering information in this way may facilitate forming parallel wellbores. For example, when forming parallel wellbores it may be desirable to maintain a predetermined distance between the wellbores to avoid the wellbores intersecting, or conversely, may be desirable to intersect wellbores to join the wellbores. Communicating information from one drilling tool assembly to another via the modulated polarized magnetic field as described herein may facilitate making steering decisions for one or more of the wellbores. For example, a steering command may be transmitting (e.g., via downlink) to one drilling tool assembly, and the drilling tool assembly may transmit the command (or complimentary command) to another drilling tool assembly. In another example, communication via the bit sequence may facilitate semi-autonomous or fully-autonomous steering and/or drilling for one or more wellbores. For example, one or more BHAs may carry out plans or instructions based on communication with another, parallel BHAs, which may reduce or eliminate the need to send downlinks to one or more of the BHAs. This may improve the speed, accuracy, quality, etc. of the downhole operations as downlinks may often be disruptive to downhole operations. In some embodiments, one BHA may be implemented to guide or control one or more other BHAs in this way, such as a master BHA carrying out steering plans or instructions and communicating information to other BHAs to mirror or follow in a similar manner. Communication from the magnetic component via the modulated polarized magnetic field may be contemplated in any number of ways and for any number of purposes in order to improve one or more downhole operations. Indeed, the downhole communication techniques described herein may be implemented to communicate any relevant information via the modulated polarized magnetic field.

Bit sequences may be transmitted in any direction, and in any orientation through the techniques described herein. For example, the orientation of the polarity may be manipulated and/or controlled in order to direct the transmission of the polarized magnetic field toward a specific target, such as toward another drilling tool assembly or well, toward the surface, or in any other direction. In some embodiments, the magnetic component may be configured to generate a polarized magnetic field that penetrates a certain distance or length through an underground formation. For example, the communication techniques described herein may facilitate communication through an underground formation up to 50 meters, 75 meters, 100 meters, 125 meters, or 150 meters. In this way, the generation and modulation of the polarized magnetic field may facilitate communication, for example, between two BHAs that are separated by up to 100 meters or more.

As described herein, the communication techniques of the present disclosure may be achieved by modulating a polarized magnetic field generated by a magnetic component, and the modulation may be facilitated based on one or more means for modulating the polarized magnetic field. Several means are described herein, although it is contemplated that the communication techniques described herein may be accomplished by any modulation to the polarized magnetic field through any sufficient means.

In some embodiments, the means for modulating the polarized magnetic field may include one or more separate components, structures, systems, and/or devices for interacting with, interfacing with, manipulating, or otherwise controlling the magnetic component. In some embodiments, the means for modulating the polarized magnetic field may be incorporated as part of the magnetic component.

In some embodiments, the means for modulating the polarized magnetic field is implemented to modulate (and encode a bit sequence into) the magnetic field through a rotation of the magnetic field and/or of the magnetic component. For example, as described herein, the polarized magnetic field may be rotated at one or more specific frequencies or changes in frequencies to represent bits of a bit sequence. In some embodiments, examples of modulating the polarized magnetic field through rotation are described herein.

In some embodiments, the polarized magnetic field may be rotated based on (e.g., dependent on) rotating one or more components or portions of the drilling tool assembly. For example, a magnetic component may be fixed at a location on a drilling tool assembly, and the magnetic component may rotate with the associated portion(s) of the drilling tool assembly to which it is fixed. For instance, the magnetic component may be a dedicated magnetic sub which may be connected or fixed between two sections of drill pipe, between components of the BHA, or between any other portions of the drilling tool assembly. In some embodiments, the magnetic component may not necessarily be a dedicated magnetic sub, but may be implemented as one or more magnets (e.g., permanent magnets and/or electromagnets) included in or as part of another component of the drilling tool assembly. For example, one or more magnets may be positioned on, within, or incorporated with a component of the BHA, on a drill pipe, in a collar, on a drill bit, or any other component of the drilling tool assembly. The magnetic component may include one magnet or may be multiple magnets, for example, to achieve a desired intensity, orientation, directionality, shape, and/or form of the polarized magnetic field.

In some embodiments, the polarized magnetic field may be modulated based on modulating a surface RPM of the drilling tool assembly. For example, the magnetic component may be fixed to any portion of the drilling tool assembly as described herein, and a top drive of the downhole system may be made to rotate at a specific frequency which in turn may change the frequency with which the magnetic component rotates, thereby imparting a desired rotation of the polarized magnetic field. In some embodiments, the polarized magnetic field may be modulated based on modulating a downhole RPM of a downhole motor. For example, the magnetic component may be fixed to a portion of a downhole motor, BHA, or other component downhole of the downhole motor, and the downhole motor may be made to rotate at a specific frequency (with or without respect to a surface RPM) which in turn may change the frequency with which the magnetic component rotates, thereby imparting a desired rotation of the polarized magnetic field. In some embodiments, the polarized magnetic field may be modulated based on modulating the surface RPM and/or downhole RPM by intentionally breaking or stalling a rotation of the drilling tool assembly or downhole motor. For example, the means for modulating the polarized magnetic field may include a stabilizer or engagement controller for selectively controlling the engagement or disengagement of a stabilizer or other engagement member with the wellbore wall which may temporarily or permanently alter the frequency of rotation of the polarized magnetic field. In another example, the means for modulating the polarized magnetic field may include a weight controller for selectively increasing or decreasing a WOB as applied to a bit and/or a reamer to temporarily or permanently alter the frequency of rotation of the polarized magnetic field. In this way, the polarized magnetic field may be rotationally fixed to one or more portions of the drilling tool assembly and the means for modulating the polarized magnetic field may be implemented as various forms of changing the frequency with which the drilling tool assembly (or a portion thereof) rotates.

In some embodiments, the polarized magnetic field may be rotated independent of a rotation of one or more portions of the drilling tool assembly. For example, some or all of a drilling tool assembly may rotate, and a magnetic component may rotate irrespective of the rotation (or lack thereof) of the drilling tool assembly. For example, a mechanical assembly may rotate the magnetic component relative to the drilling tool assembly. For instance, a means for modulating the polarized magnetic field may include an electric motor, hydraulic motor, gyroscopic component, rotational actuator, etc., for controlling an independent rotation of the magnetic component.

In accordance with at least one embodiment of the present disclosure, the drilling tool assembly (e.g., a steering system of the drilling tool assembly such as an RSS) may include a roll-stabilize platform that may be configured to rotate independent of a rotation of the drilling tool assembly, such as to facilitate steering operations. For example, the roll-stabilize platform may include gyroscopic and other stabilizing mechanisms that accommodate or compensate for the rotational movement of the drilling tool assembly while maintaining the orientation of a specific tool or instrument. In some embodiments, the magnetic component may be implemented as part of, or in connection with, a roll-stabilize platform (e.g., a roll-stabilize platform of an existing system of the drilling tool assembly) and the roll-stabilize platform may be implemented to rotate the magnetic component independent of the drilling tool assembly.

In some embodiments, the polarized magnetic field may be made to rotate independent of a rotation of the magnetic component. In this way the rotation of the polarized magnetic field may not necessarily be achieved based on rotating the magnetic component, but may be achieved based on driving a rotation of the polarized magnetic field itself. For example, in some embodiments the polarized magnetic field may be generated by an electromagnet having one or more field coils. In some embodiments the magnetic component may have several field coils at different orientations such that, by periodically energizing different field coils, a rotating magnetic field may be generated. For example, a multiphase electrical energy input may be applied to the field coils (e.g., such as in an induction motor) at a specific frequency to produce a rotating magnetic field. The electrical energy input to the electromagnet may, in this way, be controlled to rotate the magnetic field at a specific frequency or change in frequency, with or without respect to a rotation of the magnetic component and/or the drilling tool assembly.

In this way, the polarized magnetic field may be modulated based on modulating a rotation of the polarized magnetic field through any of the means described herein, or any other suitable means. Additionally, while the means for modulating the rotation of the polarized magnetic field have been primarily described with respect to achieving a specific frequency of rotation (e.g., frequency with respect to a global reference frame or with respect to the formation), it should be understood that any of the rotational means described herein may be applicable to achieve modulation of the polarized magnetic field by orienting a polarity of the magnetic field. For example, the rotational means described herein may be implemented to rotate the polarized magnetic field with respect to a rotation of the drilling tool assembly (or lack thereof) and thereby maintain the polarity oriented in a substantially fixed orientation with respect to a global reference frame (e.g., temporarily). Bits of a bit sequence, for example, may be represented by alternatingly orienting a specific pole of the polarized magnetic field in this way.

In some embodiments, the means for modulating the polarized magnetic field may include a means for controlling or varying the intensity or strength of the polarized magnetic field. For example, the electrical energy input to an electromagnet may be modified to vary the strength of the resulting polarized magnetic field. In another example, the means may include a device, material, or component for altering the strength of the polarized magnetic field (e.g., permanent or electromagnet) by shielding, concealing, or masking the polarized magnetic field. For instance, the means may implement barriers of non-magnetically penetrable materials, other magnetic fields, anti-magnetic materials, etc. to selectively inhibit the propagation of the polarized magnetic field to varying degrees from the magnetic component.

In this way, the polarized magnetic field may be modulated based on a rotation of the magnetic field, based on an oriented polarity of the magnetic field, based on a strength of the magnetic field, or based on any other form of modulation. In some embodiments, multiple magnetic components and/or multiple forms of magnetic field modulation may be implemented, for example, to achieve more sophisticated communication. For example, by modulating two or more polarized magnetic fields independently and/or by modulating two or more properties of a polarized magnetic field, communication may be facilitated through higher-order, more robust, or otherwise more sophisticated encoding techniques. For instance, a first magnetic component may be implemented on the BHA and modulated based on a downhole RPM and a surface RPM, and a second magnetic component may be implemented above the BHA (e.g., above a downhole motor) and may be modulated based only on the surface RPM. In another example, a polarized magnetic field may be driven to rotate at several different frequencies (e.g., including forward and backward) to facilitate communication over higher-order encodings (e.g., ternary, quaternary, etc.). In another example, the rotation and the intensity of the polarized magnetic field may both be modulated in conjunction to communicate more sophisticated information.

In some embodiments, a drilling tool assembly may include multiple magnetic components (and associated means for modulating) at different locations of the drilling tool assembly. For example, in some cases, a magnetic receiver may be configured to detect and/or receive a polarized magnetic field based on the magnetic receiver being substantially aligned, at a same depth as, or otherwise in a complimentary position to the magnetic component (e.g., of another drilling tool assembly). Thus, in some cases if the alignment (e.g., depth) of the magnetic component and the magnetic receiver do not match, communication may be limited or unavailable. In some embodiments, the drilling tool assembly includes multiple magnetic components (e.g., at any location of the drilling tool assembly) for providing better alignment of one or more polarized magnetic fields for propagation to a magnetic receiver.

In some embodiments, a method or a series of acts for downhole communication is described herein, according to at least one embodiment of the present disclosure.

In some embodiments, the method includes an act of receiving a bit sequence for transmitting downhole information from a downhole tool.

In some embodiments, the method includes an act of modulating a polarized magnetic field to encode the bit sequence into the polarized magnetic field. For example, the polarized magnetic field may be generated by a magnetic component associated with the downhole tool. For example, the magnetic component may generate the polarized magnetic field with a permanent magnet. In another example, the magnetic component may generate the polarized magnetic field with an electromagnet.

In some embodiments, the polarized magnetic field is modulated based on modulating a rotation of the polarized magnetic field. For example, modulating a rotation of the magnetic component may modulate the polarized magnetic field. The rotation of the magnetic component may be modulated based on modulating a surface RPM of the downhole tool. The rotation of the magnetic component may be modulated based on modulating a downhole RPM of a downhole motor associated with the downhole tool. The rotation of the magnetic component may be modulated based on controlling a WOB associated with the downhole tool to change an RPM of the downhole tool. The rotation of the modulating component may be modulated based on controlling one or more engagement members for engaging a wall of the wellbore to change an RPM of the downhole tool.

In some embodiments, the rotation of the magnetic component is modulated based on rotating the magnetic component relative to the downhole tool. For example, the magnetic component may be rotated based on rotating a roll-stabilize platform of the downhole tool relative to a rotation of the downhole tool. In some embodiments, the polarized magnetic field may be rotated and modulated based on controlling a multi-phase electrical energy input to the magnetic component.

In some embodiments, a polarity of the polarized magnetic field is oriented transverse to a longitudinal axis of the downhole tool and modulating the rotation of the polarized magnetic field includes rotating the polarity about the longitudinal axis. In some embodiments, the polarized magnetic field may be modulated based on selectively rotationally orienting the polarity of the polarized magnetic field. In some embodiments, the polarized magnetic field may be modulated based on modulating a strength of the polarized magnetic field.

In some embodiments, the method includes an act of transmitting the downhole information based on modulating the polarized magnetic field. In some embodiments, transmitting the downhole information includes transmitting steering information of the downhole tool including one or more of an azimuth or an inclination of the downhole tool.

In some embodiments, the method includes generating the bit sequence at a first downhole tool implemented in a first wellbore for transmitting the downhole information from the first downhole tool; modulating the polarized magnetic field to encode the bit sequence into the polarized magnetic field, wherein the polarized magnetic field is generated by a magnetic component of the first downhole tool; transmitting the downhole information from the first downhole tool based on modulating the polarized magnetic field; and receiving the downhole information at a second downhole tool based on detecting the modulated polarized magnetic field with a magnetic receiver of the second downhole tool. For example, the second downhole tool may be implemented in a second wellbore, and the downhole information may indicate one or more steering parameters of the first downhole tool. The method may further include adjusting one or more steering parameters of the second downhole tool based on receiving the downhole information. In some embodiments, the modulated polarized magnetic field may be detected by the second downhole tool up to 100 meters from the first downhole tool.

In some embodiments, the method includes generating a first bit sequence at a first downhole tool implemented in a first wellbore for transmitting first downhole information from the first downhole tool; modulating a first polarized magnetic field to encode the first bit sequence into the first polarized magnetic field; transmitting the first downhole information from the first downhole tool based on modulating the first polarized magnetic field; receiving the first downhole information at a second downhole tool implemented in a second wellbore based on detecting the first modulated polarized magnetic field; generating a second bit sequence at the second downhole tool for transmitting the second downhole information from the second downhole tool; modulating a second polarized magnetic field to encode the second bit sequence into the second polarized magnetic field; transmitting the second downhole information from the second downhole tool based on modulating the second polarized magnetic field; and receiving the second downhole information at the first downhole tool based on detecting the second modulated polarized magnetic field.

The following are non-limiting examples of embodiments of the present disclosure:

A1. A downhole communication device, comprising: a downhole tool implemented in a wellbore; a magnetic component connected to the downhole tool and configured to generate a polarized magnetic field; and a means for modulating the polarized magnetic field of the magnetic component to encode a bit sequence into the polarized magnetic field.

A2. The device of A1, wherein the magnetic component includes a permanent magnet.

A3. The device of A1 or A2, wherein the magnetic component includes an electromagnet.

A4. The device of any of A1-A3, wherein the means for modulating the polarized magnetic field is configured to modulate a rotation of the magnetic component to encode the bit sequence into the polarized magnetic field.

A5. The device of A4, wherein the means for modulating the polarized magnetic field includes a top drive for modulating a surface rotational speed (RPM) associated with the downhole tool to modulate the rotation of the magnetic component.

A6. The device of A4 or A5, wherein the means for modulating the polarized magnetic field includes a downhole motor for modulating a downhole RPM associated with the downhole tool to modulate the rotation of the magnetic component.

A7. The device of any of A4-A6, wherein the means for modulating the polarized magnetic field includes a rotational actuator configured to modulate the rotation of the magnetic component independent of an RPM of the downhole tool.

A8. The device of A7, wherein the rotational actuator includes an electric motor.

A9. The device of A7 or A8, wherein the rotational actuator includes a roll-stabilize platform of the downhole tool.

A10. The device of any of A4-A9, wherein the means for modulating the polarized magnetic field includes one or more engagement elements for selectively engaging a wall of the wellbore to modulate an RPM of the downhole tool and to modulate the rotation of the magnetic component.

A11. The device of any of A4-A10, wherein the means for modulating the polarized magnetic field includes a weight on bit controller for selectively controlling a weight on bit associated with the downhole tool to modulate the rotation of the magnetic component.

A12. The device of any of A1-A11, wherein the means for modulating the polarized magnetic field includes a mechanical or electrical controller for controlling the intensity of the polarized magnetic field generated by the magnetic component.

A13. The device of any of A1-A12, wherein a polarity of the polarized magnetic field is oriented transverse to a longitudinal axis of the downhole tool.

A14. The device of any of A1-A14, wherein the means for modulating the polarized magnetic field is configured to modulate a rotation of the polarized magnetic field to selectively rotationally orient a polarity of the polarized magnetic field to encode the bit sequence B1. A downhole communication system comprising: a first downhole tool implemented in a first wellbore; a magnetic component connected to the first downhole tool and configured to generate a polarized magnetic field; a means for modulating the polarized magnetic field of the magnetic component to encode a bit sequence into the polarized magnetic field; and a magnetic receiver configured to receive the encoded bit sequence based on detecting the modulated polarized magnetic field.

B2. The system of B1, wherein the magnetic receiver is connected to a second downhole tool.

B3. The system of B2, wherein the second downhole tool is implemented in a second wellbore.

C1. A downhole communication system comprising: a first downhole tool;

a second downhole tool; a first magnetic component connected to the first downhole tool and configured to generate a first polarized magnetic field; a first means for modulating the first polarized magnetic field of the first magnetic component to encode a first bit sequence into the first polarized magnetic field; a first magnetic receiver connected to the second downhole tool and configured to receive the encoded first bit sequence based on detecting the modulated first polarized magnetic field; a second magnetic component connected to the second downhole tool and configured to generate a second polarized magnetic field; a second means for modulating the second polarized magnetic field of the second magnetic component to encode a second bit sequence into the second polarized magnetic field; and a second magnetic receiver connected to the first downhole tool and configured to receive the encoded second bit sequence based on detecting the modulated second polarized magnetic field.

C2. The system of C1, wherein the first downhole tool is implemented in a first wellbore and the second downhole tool is implemented in a second wellbore.

C3. The system of C1 or C2, wherein the first and second means for modulating the first and second polarized magnetic fields are each configured to modulation a rotation of the associated polarized magnetic field to encode the associated bit sequence.

D1. A method of downhole communication, comprising: receiving a bit sequence for transmitting downhole information from a downhole tool implemented in a wellbore; modulating a polarized magnetic field to encode the bit sequence into the polarized magnetic field, wherein the polarized magnetic field is generated by a magnetic component associated with the downhole tool; and transmitting the downhole information based on modulating the polarized magnetic field.

D2. The method of D1, wherein modulating the polarized magnetic field includes modulating a rotation of the polarized magnetic field.

D3. The method of D1 or D2, wherein modulating the rotation of the polarized magnetic field is based on modulating a rotation of the magnetic component.

D4. The method of D3, wherein modulating the rotation of the magnetic component is based on modulating a surface rotational speed (RPM) of the downhole tool.

D5. The method of D3 or D4, wherein modulating the rotation of the magnetic component is based on modulating a downhole RPM of a downhole motor associated with the downhole tool.

D6. The method of any of D3-D5, wherein modulating the rotation of the magnetic component is based on controlling a weight on bit associated with the downhole tool to change an RPM of the downhole tool.

D7. The method of any of D3-D6, wherein modulating the rotation of the magnetic component is based on controlling one or more engagement members for engaging a wall of the wellbore to change an RPM of the downhole tool.

D8. The method of any of D3-D7, wherein modulating the rotation of the magnetic component is based on rotating the magnetic component relative to the downhole tool.

D9. The method of D8, wherein modulating the rotation of the magnetic component is based on rotating a roll-stabilize platform of the downhole tool relative to a rotation of the downhole tool.

D10. The method of any of D2-D9, wherein modulating the rotation of the polarized magnetic field is based on controlling a multi-phase electrical energy input to the magnetic component.

D11. The method of any of D2-D10, wherein a polarity of the polarized magnetic field is oriented transverse to a longitudinal axis of the downhole tool and modulating the rotation of the polarized magnetic field includes rotating the polarity about the longitudinal axis.

D12. The method of any of D1-D11, wherein modulating the polarized magnetic field includes modulating a strength of the polarized magnetic field.

D13. The method of any of D1-D12, wherein modulating the polarized magnetic field includes selectively rotationally orienting a polarity of the polarized magnetic field.

D14. The method of any of D1-D13, wherein transmitting the downhole information includes transmitting steering information of the downhole tool including one or more of an azimuth or an inclination of the downhole tool.

D15. The method of any of D1-D14, wherein the magnetic component generates the polarized magnetic field with a permanent magnet.

D16. The method of any of D1-D16, wherein the magnetic component generates the polarized magnetic field with an electromagnet.

E1. A method of downhole communication, comprising: generating a bit sequence at a first downhole tool implemented in a first wellbore for transmitting downhole information from the first downhole tool; modulating a polarized magnetic field to encode the bit sequence into the polarized magnetic field, wherein the polarized magnetic field is generated by a magnetic component of the first downhole tool; transmitting the downhole information from the first downhole tool based on modulating the polarized magnetic field; and receiving the downhole information at a second downhole tool based on detecting the modulated polarized magnetic field with a magnetic receiver of the second downhole tool.

E2. The method of E1, wherein the second downhole tool is implemented in a second wellbore, wherein the downhole information indicates one or more steering parameters of the first downhole tool, and wherein the method further includes adjusting one or more steering parameters of the second downhole tool based on receiving the downhole information.

E3. The method of E1 or E2, wherein detecting the modulated polarized magnetic field includes detecting the modulated polarized magnetic field at the second downhole tool up to 100 meters from the first downhole tool.

F1. A method of downhole communication comprising: generating a first bit sequence at a first downhole tool implemented in a first wellbore for transmitting first downhole information from the first downhole tool; modulating a first polarized magnetic field to encode the first bit sequence into the first polarized magnetic field; transmitting the first downhole information from the first downhole tool based on modulating the first polarized magnetic field; receiving the first downhole information at a second downhole tool implemented in a second wellbore based on detecting the first modulated polarized magnetic field; generating a second bit sequence at the second downhole tool for transmitting the second downhole information from the second downhole tool; modulating a second polarized magnetic field to encode the second bit sequence into the second polarized magnetic field; transmitting the second downhole information from the second downhole tool based on modulating the second polarized magnetic field; and receiving the second downhole information at the first downhole tool based on detecting the second modulated polarized magnetic field.

The embodiments of the downhole communication techniques have been primarily described with reference to wellbore drilling operations; the downhole communication techniques described herein may be used in applications other than the drilling of a wellbore. In other embodiments, the downhole communication techniques according to the present disclosure may be used outside a wellbore or other downhole environment used for the exploration or production of natural resources. For instance, the downhole communication techniques of the present disclosure may be used in a borehole used for placement of utility lines. Accordingly, the terms "wellbore," "borehole" and the like should not be interpreted to limit tools, systems, assemblies, or methods of the present disclosure to any particular industry, field, or environment.

One or more specific embodiments of the present disclosure are described herein. These described embodiments are examples of the presently disclosed techniques. Additionally, in an effort to provide a concise description of these embodiments, not all features of an actual embodiment may be described in the specification. It should be appreciated that in the development of any such actual implementation, as in any engineering or design project, numerous embodiment-specific decisions will be made to achieve the developers' specific goals, such as compliance with system-related and business-related constraints, which may vary from one embodiment to another. Moreover, it should be appreciated that such a development effort might be complex and time consuming, but would nevertheless be a routine undertaking of design, fabrication, and manufacture for those of ordinary skill having the benefit of this disclosure.

Additionally, it should be understood that references to "one embodiment" or "an embodiment" of the present disclosure are not intended to be interpreted as excluding the existence of additional embodiments that also incorporate the recited features. For example, any element described in relation to an embodiment herein may be combinable with any element of any other embodiment described herein. Numbers, percentages, ratios, or other values stated herein are intended to include that value, and also other values that are "about" or "approximately" the stated value, as would be appreciated by one of ordinary skill in the art encompassed by embodiments of the present disclosure. A stated value should therefore be interpreted broadly enough to encompass values that are at least close enough to the stated value to perform a desired function or achieve a desired result. The stated values include at least the variation to be expected in a suitable manufacturing or production process, and may include values that are within 5%, within 1%, within 0.1%, or within 0.01% of a stated value.

A person having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the embodiments that falls within the meaning and scope of the claims is to be embraced by the claims.

The terms "approximately," "about," and "substantially" as used herein represent an amount close to the stated amount that is within standard manufacturing or process tolerances, or which still performs a desired function or achieves a desired result. For example, the terms "approximately," "about," and "substantially" may refer to an amount that is within less than 5% of, within less than 1% of, within less than 0.1% of, and within less than 0.01% of a stated amount. Further, it should be understood that any directions or reference frames in the preceding description are merely relative directions or movements. For example, any references to "up" and "down" or "above" or "below" are merely descriptive of the relative position or movement of the related elements. Additionally, as used herein, the term "and/or" includes any and all combinations of one or more of the associated listed items.

The present disclosure may be embodied in other specific forms without departing from its spirit or characteristics. The described embodiments are to be considered as illustrative and not restrictive. The scope of the disclosure is, therefore, indicated by the appended claims rather than by the foregoing description. Changes that come within the meaning and range of equivalency of the claims are to be embraced within their scope.

What is claimed is:

1. A downhole communication device, comprising:

a downhole tool implementable in a wellbore;

a magnetic component connected to the downhole tool and configured to generate a polarized magnetic field; and a motor configured to rotationally modulate the polarized magnetic field of the magnetic component by rotating the magnetic component independent of a rotation of a bit and a drill string connected to the downhole tool, wherein the motor is configured to rotationally modulate the polarized magnetic field by rotating the magnetic component according to a bit sequence, to transmit bits of the bit sequence via the rotational modulations of the polarized magnetic field, wherein different bit values of the bit sequence are represented via different threshold rotational frequencies of the rotational modulations.

2. The downhole communication device of claim 1, wherein the motor includes a hydraulic motor.

3. The downhole communication device of claim 1, wherein the motor includes an electric motor.

4. The downhole communication device of claim 1, wherein the motor includes a roll-stabilize platform of the downhole tool.

5. The downhole communication device of claim 1, wherein a polarity of the polarized magnetic field is oriented transverse to a longitudinal axis of the downhole tool.

6. A downhole communication system comprising:

a first downhole tool implemented in a first wellbore;

a magnetic component connected to the first downhole tool and configured to generate a polarized magnetic field;

a motor configured to rotationally modulate the polarized magnetic field of the magnetic component by rotating the magnetic component independent of a rotation of a drill string and a bit connected to the first downhole tool, wherein the motor is configured to rotationally modulate the polarized magnetic field by rotating the magnetic component according to a bit sequence, to transmit bits of the bit sequence via the rotational modulations of the polarized magnetic field, wherein different bit values of the bit sequence are represented via different threshold rotational frequencies of the rotational modulations; and a magnetic receiver configured to receive the bit sequence based on detecting the rotational modulations of the polarized magnetic field.

7. The downhole communication system of claim 6, wherein the magnetic receiver is connected to a second downhole tool.

8. The downhole communication system of claim 7, wherein the second downhole tool is implemented in a second wellbore.

9. A method of downhole communication, comprising:

receiving a bit sequence for transmitting downhole information from a downhole tool implemented in a wellbore;

rotationally modulating a polarized magnetic field to encode bits of the bit sequence into the rotational modulations of the polarized magnetic field, wherein the polarized magnetic field is generated by a magnetic component associated with the downhole tool, wherein the polarized magnetic field is modulated according to the bit sequence based on rotating the magnetic component with a motor and independent of a rotation of a bit and a drill string connected to the downhole tool, and wherein different bit values of the bit sequence are represented via different threshold rotational frequencies of the rotational modulations; and transmitting the downhole information based on modulating the polarized magnetic field.

10. The method of claim 9, wherein modulating the polarized magnetic field includes rotating magnetic component with an electric motor or a hydraulic motor.

11. The method of claim 9, wherein modulating the rotation of the polarized magnetic field includes rotating the magnetic component with a roll-stabilize platform of the downhole tool.

12. The downhole communication device of claim 1, wherein the motor includes an electric motor, a hydraulic motor, a gyroscopic component, a rotational actuator, or a roll-stabilize platform configured to rotate the magnetic component independent of the rotation of the bit of the downhole tool.

* * * * *